US005498355A

United States Patent [19]

Perozzi et al.

[11] Patent Number: 5,498,355

[45] Date of Patent: Mar. 12, 1996

[54] LUBRICANT COMPOSITIONS OF ENHANCED PERFORMANCE CAPABILITIES

[75] Inventors: Edmund F. Perozzi, Glen Allen; Charles A. Passut, Midlothian, both of Va.

[73] Assignee: Ethyl Corporation, Richmond, Va.

[21] Appl. No.: 309,976

[22] Filed: Sep. 20, 1994

[51] Int. Cl.[6] ..... C10M 133/44

[52] U.S. Cl. ..... 252/49.6; 252/51.5 A

[58] Field of Search ..... 252/49.6, 51.5 A

[56] References Cited

U.S. PATENT DOCUMENTS

| | | | |
|---|---|---|---|
| 2,979,528 | 4/1961 | Lundsted | 260/584 |
| 3,089,850 | 5/1963 | McConnell et al. | 252/32.7 |
| 3,211,652 | 10/1965 | Hinkamp | 252/49.8 |
| 3,637,498 | 1/1972 | Pollak | 252/32.7 |
| 3,821,302 | 6/1974 | Hu | 260/556 R |
| 3,840,549 | 8/1974 | Blaha et al. | 260/302 SD |
| 4,011,380 | 3/1977 | West et al. | 526/30 |
| 4,105,571 | 8/1978 | Shaub et al. | 252/32.7 E |
| 4,356,097 | 10/1982 | Papay | 252/33.4 |
| 4,466,895 | 8/1984 | Schroeck | 252/32.7 E |
| 4,519,929 | 5/1985 | O'Brien et al. | 252/51.5 A |
| 4,827,037 | 5/1989 | Doumaux, Jr. | 564/479 |
| 4,873,009 | 10/1989 | Anderson | 252/49.6 |
| 4,981,578 | 1/1991 | Tycer et al. | 208/262.1 |
| 5,013,463 | 5/1991 | Slama | 252/18 |
| 5,114,601 | 5/1992 | Cook et al. | 252/25 |
| 5,114,602 | 5/1992 | Petrille et al. | 252/49.6 |
| 5,137,980 | 8/1992 | DeGonia et al. | 525/327.6 |
| 5,205,946 | 5/1993 | Cook et al. | 252/25 |
| 5,308,521 | 5/1994 | Pavilon et al. | 252/49.6 |
| 5,445,750 | 8/1995 | Chafetz et al. | 252/51.5 A |

FOREIGN PATENT DOCUMENTS

| | | |
|---|---|---|
| 20037 | 5/1980 | European Pat. Off. . |

*Primary Examiner*—Jacqueline V. Howard

*Attorney, Agent, or Firm*—Dennis H. Rainear; William H. Thrower

[57] ABSTRACT

A novel dispersant composition is described which has been found to possess excellent dispersancy performance. When suitably formulated, lubricants can be formed that exhibit superior performance in a wide variety of rigorous qualification tests.

40 Claims, No Drawings

LUBRICANT COMPOSITIONS OF ENHANCED PERFORMANCE CAPABILITIES

TECHNICAL FIELD

This invention relates to novel and eminently useful dispersant compositions for use in lubricating oils, especially in the formulation of engine oils, and most especially heavy duty crankcase lubricating oil compositions and additive concentrates therefor.

BACKGROUND

In the formulation of lubricant additive concentrates (also known as DI-packages) and finished lubricating oils such as crankcase lubricating oils, one is continuously confronted by the truism that things never stand still. In order to be successful in the field, it is necessary to provide compositions which satisfy ever-increasingly difficult performance demands imposed upon them by purchasers, consumers original equipment manufacturers, and industry groups. One of the key components in such compositions is the dispersant component, and in order to have any chance of achieving the present-day performance standards the dispersant must not only be highly effective in its own right, but must be capable of maintaining its high performance level when in combination with various other components utilized in the search for compositions that can achieve the these standards. And in this search, the performance interactions among components of a proposed DI-package can only be ascertained by experiment. Then, and only then, can valid predictions be made concerning performance capabilities of a given class of formulations.

GLOSSARY OF TERMS

As used herein, GPC means gel permeation chromatography using calibrated columns in accordance with known procedures, the succination ratio is the ratio of succinic groups to alkenyl groups chemically bound together in the chemical structure of the dispersant, TBN means total base number in terms of mg KOH per gram of detergent composition using the ASTM D2896 procedure, and TSA means total sulfated ash in terms of weight percent using the ASTM D874 procedure.

THE INVENTION

In accordance with this invention there is provided a novel dispersant composition which has been found to possess the necessary level of high dispersancy performance. Moreover, when suitably formulated pursuant to this invention, lubricants can be formed that exhibit excellent performance in a wide variety of rigorous qualification tests.

In accordance with one embodiment of this invention there is provided a dispersant composition which comprises a) a first succinic derivative dispersant produced by reacting (i) a substituted succinic acylating agent in which the substituent is an aliphatic group derived from polyalkene having a GPC number average molecular weight in the range of about 700 to about 2500, preferably about 800 to about 1400 with (ii) alkylene polyamine having an average of about 3 to about 6 nitrogen atoms per molecule, wherein (i) has a succination ratio below 1.3 and wherein the mole ratio of (i) to (ii) in said first succinic derivative dispersant is below about 1.85, preferably in the range of about 1.75 to about 1.85; and b) a second succinic derivative dispersant produced by reacting (iii) a substituted succinic acylating agent in which the substituent is an aliphatic group derived from polyalkene having a GPC number average molecular weight in the range of about 1100 to about 2800 with (iv) hydroxypropylated alkylene diamine having an average of 2 to about 12 carbon atoms per molecule and an average of about 2.5 to about 3.5 hydroxypropyl groups per molecule, wherein (iii) has a succination ratio below about 1.3 and wherein the mole ratio of (iii) to (iv) in said second succinic derivative dispersant is in the range of 1.0 to about 1.5;

the weight ratio of a) to b) being such that on an active ingredient basis there are from about 0.25 to about 10 parts by weight of a) per part by weight of b), and preferably from about 0.5 to about 5 parts by weight of a) per part by weight of b). As an additive composition, components a) and b) are normally in admixture with a minor amount of a diluent oil such as a light mineral oil. When components a) and b) are formulated into lubricant compositions, the overall composition typically comprises a major amount of at least one oil of lubricating viscosity.

Components a) and b) proportioned as above work effectively with alkali and/or alkaline earth metal-containing detergents (e.g., sulfonates, phenates, sulfurized phenates, and carboxylates) to effectively control accumulation of deposits, sludge and varnish on engine parts. Enhanced stability and wear inhibition are achieved by combining an oil-soluble dithiophosphate material with components a) and b) proportioned as above, particularly when alkali and/or alkaline earth metal-containing detergents are also included in the composition. Still greater stability results by including in these compositions one or more oil-soluble antioxidants such as are described hereinafter.

The amount of components a) and b), proportioned as specified above, and on an active ingredient basis (i.e., excluding the weight of any solvent or diluent associated with either or both such components) in the finished lubricants of this invention typically will be in the range of about 1 to about 10 wt %, and preferably in the range of about 2 to about 5 wt %, of the total weight of the finished lubricant composition. Most preferably, the amount will be in the range of about 3 to about 4 wt % of the total weight of the finished lubricant composition.

Preferably component b) is borated by reaction with a suitable boron-containing reagent. On the other hand, component a) is preferably utilized in non-borated form.

A preferred embodiment of this invention from the cost-effectiveness standpoint in the control of deposit, sludge and varnish accumulation on engine parts is a lubricant additive composition or finished lubricating oil composition which comprises components a) and b) above and a detergent complement composed of c) at least one calcium phenate or calcium sulfurized phenate composition having a TBN in the range of about 160 to about 260, and d) at least one calcium sulfonate having a TBN of up to about 420. When the calcium sulfonate used has a TBN of up to about 50 (e.g., in the range of about 20 to about 50), the total TSA content of the finished lubricant is preferably no higher than about 1.8 wt %, e.g., in the range of about 0.2 to about 1.8 wt %, and more preferably in the range of about 0.4 to about 1.4 wt %. Thus when using a calcium sulfonate having a TBN of up to about 50 in preparing an additive concentrate of this invention, the concentrate is preferably formulated such that at the recommended dosage level of the concentrate in the finished oil, the TSA content of the finished lubricant will be no higher than about 1.8 wt %, and more preferably will be in the range of about 0.4 to about 1.4 wt %. On the other hand, when the calcium sulfonate used has a TBN greater than about 50 (e.g., in the range of about 50 to about 420), the TSA content of the finished lubricant is preferably up to about 2.5 wt %, e.g., in the range of about 0.7 to about 2.5 wt %, and more preferably in the range of about 0.8 to about 2.2 wt %. Thus when using a calcium sulfonate having a TBN of greater than about 50 in preparing an additive concentrate of this invention, the concentrate is preferably formulated such that at the recommended dosage level of the concentrate in the finished oil, the TSA content of the finished lubricant is preferably no higher than about 2.5 wt %, and more preferably will be in the range of about 0.8 to about 2.2 wt %.

Still another preferred embodiment of this invention is a lubricant or additive concentrate containing components a) and b) above and e) at least one oil-soluble dithiophosphate material in an amount such that the finished lubricant contains in the range of about 0.02 to about 0.18 wt % of phosphorus, and preferably in the range of about 0.06 to about 0.15 wt % phosphorus, as the dithiophosphate material. These combined additives work together to provide highly effective control of wear, as well as control of sludge and varnish deposition. The inclusion in these compositions of components c) and d) in the proportions described above constitutes a particularly preferred embodiment of this invention.

Additional preferred embodiments of this invention are lubricants and additive concentrates as described above which contain f) at least one oil-soluble antioxidant, preferably at least one secondary aromatic amine antioxidant. Most preferably the lubricant or additive concentrate additionally contains one or more additional antioxidants such as (i) at least one oil-soluble sulfurized olefin having about 10 to about 30 carbon atoms in the molecule (preferably an average of about 16 to about 24 carbon atoms per molecule), and a sulfur content of about 15 to 25 wt %; and/or (ii) at least one oil-soluble sulfurized phenol having about 30 to about 100 carbon atoms in the molecule (preferably an average of about 50 to about 70 carbon atoms per molecule), and a sulfur content of about 5 to 15 wt %; and/or (iii) an oil-soluble phenolic antioxidant, preferably an oil-soluble hindered phenolic antioxidant; and/or (iv) an oil-soluble copper-containing antioxidant. The foregoing materials whether used singly or in combinations are used in amounts sufficient to inhibit oxidative degradation, i.e., they are used in antioxidant quantities. Thus in most cases the amount of antioxidant(s) used in formulating the additive concentrates of this invention are such that the finished lubricants of this invention will typically contain in the range of about 0.2 to about 0.8 wt % of the antioxidant component(s). The copper antioxidants are typically employed in the finished lubricants in amounts corresponding to not more than about 500 ppm of copper.

Further preferred embodiments of this invention are lubricants and additive concentrates as described above which contain g) at least one oil-soluble demulsifying agent and/or h) at least one oil-soluble corrosion inhibitor, especially a rust inhibitor. The demulsifiers are used in amounts such that the finished lubricant contains a demulsifying amount thereof, typically in the range of about 0.005 to about 0.2 wt % and preferably in the range of about 0.005 to about 0.1 wt %. The amounts of corrosion or rust inhibitors used are such that the finished lubricant contains a corrosion-inhibiting or rust-inhibiting amount thereof, typically in the range of about 0.05 to about 0.5 wt % and preferably in the range of about 0.05 to about 0.3 wt %.

The additive concentrates of this invention will normally contain a minor amount (and preferably no more than about 40% by weight) of one or more inert diluents such as light mineral oil. These diluents, or a portion thereof, may be one or more diluents which were associated with one or more components used in formulating the additive concentrate (sometimes referred to as a "DI-package"). The balance of the additive concentrate is composed of the additive components being utilized in the concentrate.

These and still other embodiments of this invention will become still further apparent from the ensuing description and appended claims.

A feature of this invention is that the dispersant compositions of this invention are more effective in providing high temperature piston cleanliness performance than the closest known prior art dispersant composition, a dispersant composition which was used in heavy duty diesel lubricants. That composition was composed of component b) as described above and a succinimide dispersant of the same type as the above component a) except that the mole ratio of (i) to (ii) thereof was 2:1 instead of below about 1.85 as required pursuant to this invention. When used as the dispersant on three occasions in an SAE 15W-40 heavy duty engine oil formulation that satisfied the requirements of API classification CE, the prior art dispersant gave three failing results in the Caterpillar 1K engine test procedure. In sharp contrast, four different SAE 15W-40 heavy duty engine oils of this invention in which the dispersant was a dispersant composition of this invention all passed the Caterpillar 1K engine test. The test data are presented hereinafter.

Another feature of this invention is that the compositions of this invention enable formulation of finished heavy duty engine oils which can pass a wide variety of rigorous qualification tests required for commercial acceptance. Illustrative data are presented hereinafter.

Component a)

As noted above the novel dispersant systems of this invention comprise two carefully defined components, both of which are succinic derivative dispersants. The first such dispersant component is produced by reacting (i) a substituted succinic acylating agent in which the substituent is an aliphatic group derived from polyalkene having a GPC number average molecular weight in the range of about 700 to about 2500, preferably about 800 to about 1400 with (ii) alkylene polyamine having an average of about 3 to about 6 nitrogen atoms per molecule, wherein (i) has a succination ratio below 1.3 and wherein the mole ratio of (i) to (ii) in said first succinic derivative dispersant is below about 1.85, preferably in the range of about 1.75 to about 1.85.

The substituted succinic acylating agent used in forming component a) is an alkenyl succinic anhydride, alkenyl succinic acid, alkenyl succinic partial acid-partial lower ester, alkenyl succinic acid halide, or alkenyl succinic lower alkyl ester. Of these, the use of an alkenyl succinic anhydride is preferred as these acylating agents are readily prepared by heating a mixture of a polyolefin and maleic anhydride to about 180°–220° C. The reaction can be conducted in the presence of a small amount of a catalyst such as aluminum chloride, and the polyolefin can be reacted with a small amount of chlorine to enhance reaction rate. In lieu of, or in addition to, maleic anhydride, the polyolefin or chlorinated polyolefin can be reacted with other similar materials such as maleic acid, fumaric acid, itaconic acid, or the like, including mixtures of two or more such substances. The polyolefin is preferably a polymer or copolymer of a lower monoolefin such as ethylene, propylene, 1-butene, isobutene and the like. The more preferred source of alkenyl group is from polyisobutene having a number average molecular weight of 700 to about 2500, and preferably in the range of about 800 to about 1400. In a still more preferred embodiment the alkenyl group is a polyisobutenyl group having a number average molecular weight in the range of about 1200 to about 1400. The number average molecular weights are typically determined by use of gel permeation chromatography (GPC) using columns calibrated by use of standard polymers of controlled molecular weight. The well-known manufacturers and suppliers of such polymers normally identify the molecular weights of their polymers in this manner, and the molecular weight values given by such reliable suppliers for their polyolefin products such as polyisobutene can safely be relied upon when selecting the respective polymers for use in preparing the acylating agents used for making component a) and component b).

The isobutene used in making the polyisobutene is usually (but not necessarily) a mixture of isobutene and other $C_4$ isomers such as 1-butene. Thus, strictly speaking, the acylating agent formed from maleic anhydride and "polyisobutene" made from such mixtures of isobutene and other $C_4$ isomers such as 1-butene, can be termed a "polybutenyl succinic anhydride" and a succinimide made therewith can be termed a "polybutenyl succinimide". However, it is common to refer to such substances as "polyisobutenyl succinic anhydride" and "polyisobutenyl succinimide", respectively. As used herein "polyisobutenyl" is used to denote the alkenyl moiety whether made from a highly pure isobutene or a more impure mixture of isobutene and other $C_4$ isomers such as 1-butene.

The alkylene polyamines used in forming component a) contain a substantial proportion (e.g., at least about 50 wt %, and preferably at least about 70 wt %) of alkylene polyamine species having at least one primary amino group capable of forming an imide group on reaction with a hydrocarbon-substituted succinic acid or acid derivative thereof such an anhydride, lower alkyl ester, acid halide, or acid-ester. Representative examples of such materials include the ethylene polyamines, the propylene polyamines and the butylene polyamines, and these may be linear and/or branched and may include cyclic species. Highly pure alkylene polyamines can be used if desired, although it is generally preferred for economic reasons to use technical grade materials which contain combinations of linear, branched and cyclic species. Small proportions of hydroxy-substituted alkylene polyamines species may also be present in suitable commercial alkylene polyamine products.

Individual linear ethylene polyamines and linear ethylene polyamine mixtures can be depicted by the formula $H_2N(CH_2CH_2NH)_nH$. In the individual compounds when used as such, n is from about 3 to about 6. When mixtures are used, n is an integer from 1 to about 10 for individual species in the mixture, with the overall mixture having an average value for n in the range of about 3 to about 6. These linear mixtures may include: ethylene diamine, diethylene triamine, triethylene tetramine, tetraethylene pentamine, pentaethylene hexamine, hexaethylene heptamine, heptaethylene octamine, octaethylene nonamine, and the like. These ethylene polyamines have a primary amine group at each end and thus can form mono-alkenylsuccinimides and bis-alkenylsuccinimides.

Commercially available ethylene polyamine mixtures usually contain minor amounts of branched species such as tris(2-aminoethyl)amine and N,N-di(2-aminoethyl)diethylenetriamine, and cyclic species such as N-aminoethyl piperazine, N,N'-bis(aminoethyl)piperazine, N,N'-bis(piperazinyl)ethane, and like compounds. Commercially-available product mixtures known in the art as triethylene tetramine, tetraethylene pentamine and pentaethylene hexamine are examples of suitable alkylene polyamines. The preferred commercial mixtures have approximate overall compositions falling in the range corresponding to diethylene triamine to pentaethylene hexamine, mixtures generally corresponding in overall makeup to tetraethylene pentamine being most preferred. Methods for the production of polyalkylene polyamines are known and reported in the literature. See for example U.S. Pat. No. 4,827,037 and references cited therein.

As used herein the term "succinimide" is meant to encompass the completed reaction product from reaction between the amine reactant(s) and the hydrocarbon-substituted carboxylic acid or anhydride (or like acid derivative) reactant(s), and is intended to encompass compounds wherein the product may have amide, amidine, and/or salt linkages in addition to the imide linkage of the type that results from the reaction of a primary amino group and an anhydride moiety.

Details on methods for preparing succinic acylating agents and succinimide dispersants are given, for example, in U.S. Pat. Nos. 3,172,892; 3,202,678; 3,216,936; 3,219,666; 3,254,025; 3,272,746; 4,234,435; 5,071,919; 5,137,978; and 5,137,980. Such general methods can be employed, provided that (1) the polyolefin used in forming the substituted succinic acylating agent has the requisite number average molecular weight as described above, (2) the succination ratio of the substituted succinic acylating agent is below about 1.3, and (3) the succinic acylating agent and alkylene polyamine are reacted in proportions such that a succinimide product is produced in which the mole ratio of succinic acylating agent to alkylene polyamine is below about 1.85.

Residual unsaturation in the alkenyl group of the alkenyl succinimide may be used as a reaction site, if desired. For example the alkenyl substituent may be hydrogenated to form an alkyl substituent. Similarly the olefinic bond(s) in the alkenyl substituent may be sulfurized, halogenated, hydrohalogenated or the like. Ordinarily, there is little to be gained by use of such techniques, and thus the use of alkenyl succinimides is preferred.

HiTEC® 646 additive (Ethyl Petroleum Additives, Inc.) is a highly preferred commercially available product for use as component a).

Component b)

The second succinate derivative dispersant utilized pursuant to this invention is produced by reacting a substituted succinic acylating agent in which the substituent is an aliphatic group derived from polyalkene having a GPC number average molecular weight in the range of about 1100 to about 2800 with hydroxypropylated alkylene diamine having an average of 2 to about 12 carbon atoms per molecule and an average of about 2.5 to about 3.5 hydroxypropyl groups per molecule. The substituted succinic acylating agent used for preparing component b) has a succination ratio below about 1.3, and the mole ratio of the acylating agent to the hydroxypropylated alkylene diamine in component b) is in the range of 1.0 to about 1.5.

The substituted succinic acylating agent used in producing component b) is made in similar manner to the succinic acylating agent used in forming component a) with the exception that the GPC number average molecular weight for the component b) acylating agent is in the range of about 1100 to about 2800.

Hydroxypropylated alkylene diamines used in forming component b) have an average of 2 to about 12 carbon atoms per molecule and an average of about 2.5 to about 3.5 hydroxypropyl groups per molecule. These products are readily made by reacting propylene oxide with an alkylene diamine having from 2 to about 12 carbon atoms per molecule. The alkylene diamines can be individual compounds or mixtures of the individual compounds. Thus the alkylene diamines can be represented by the formula $H_2N$—R—$NH_2$ where R is an alkylene group of from 2 to about 12 carbon atoms. The alkylene group can be straight or branched chain in structure. A particularly preferred alkylene diamine is hexamethylene diamine.

The propoxylation reaction is typically conducted at a temperature in the range of about 50° to about 200° C. The propylene oxide and alkylene diamine are proportioned such that the resultant hydroxypropylated alkylene diamine product has an average of about 2.5 to about 3.5 hydroxypropyl groups per molecule.

Reaction between the appropriate substituted succinic acylating agent and the hydroxypropylated alkylene diamine is conducted by proportioning these reactants such that the mole ratio of the acylating agent to the hydroxypropylated alkylene diamine in the resultant product is in the range of 1.0 to about 1.5. This reaction is preferably carried out in a suitable reaction diluent such as a light mineral oil. A suitable temperature in the range of about 100° to about 250° C. is employed for effecting the reaction between the substituted succinic acylating agent and the hydroxypropylated alkylene diamine.

When it is desired to use component b) in borated form, boration of the product formed by reaction between the substituted succinic acylating agent and the hydroxypropylated alkylene diamine is usually effected by heating the product with a suitable borating agent such as a boron acid, a boron ester, a boron oxide, a boron halide, an ammonium salt of a boron acid, a super-borated ashless dispersant (i.e., a dispersant that has been heated with a large amount of a boron compound such as a boron acid, oxide or ester and thus is itself suitable as a borating agent), or the like. The boron compound can be reacted in a ratio of from about 0.1 to about 10 moles of boron compound per mole of the product formed by reaction of the substituted acylating agent and the hydroxypropylated alkylene diamine. It is also possible, but less preferred to conduct the boration concurrently with the reaction between the substituted succinic acylating agent and the hydroxypropylated alkylene diamine. Another possible alternative is to borate the hydroxypropylated alkylene diamine prior to conducting the acylation reaction.

When and however borated, component b) will typically contain from about 0.05 to about 7.5 weight percent of boron, preferably from about 0.1 to about 6.5 weight percent of boron, and most preferably from about 0.2 to about 1 weight percent of boron, each based on the weight of component b), and excluding the weight of any solvent or diluent that may be, and usually is, associated therewith.

Details concerning the synthesis of products suitable for use as component b) can be found within the disclosure of U.S. Pat. No. 4,873,009. An excellent commercially available product for use as component b) is HiTEC® 7714 additive (Ethyl Petroleum Additives, Inc.).

Metal-containing detergents

The metal-containing detergents which preferably are employed in conjunction with components a) and b) of the compositions of this invention oil-soluble or oil-dispersible metal salts of one or more suitable organic acids. Such detergents are exemplified by oil-soluble salts of alkali or alkaline earth metals with one or more of the following acidic substances (or mixtures thereof): (1) sulfonic acids, (2) carboxylic acids, and (3) alkylphenols or sulfurized alkylphenols. Other metal-containing detergents are known and can be used if desired. For example, metal salts of organic phosphorus acids that have at least one direct carbon-to-phosphorus linkage can be used. Also useful are metal calixarates such as are described in U.S. Pat. Nos. 5,114,601 and 5,205,946.

The most commonly used metal detergent salts are those in which the metal is an alkali metal or an alkaline earth metal, especially sodium, potassium, lithium, calcium, magnesium, and barium. The salts preferably comprise basic salts having a TBN of at least 50, preferably above 100, and most preferably above 200. However neutral or low-base metal-containing detergents can also be included in the compositions of this invention. The neutral or low-base detergents of this type are those which contain an essentially stoichiometric equivalent quantity of metal in relation to the amount of acidic moieties present in the detergent. Thus in general, the neutral detergents will have a TBN of up to about 50. Combinations of neutral or low-base detergents and overbased detergents can also be employed.

The term "basic salt" is sometimes used to designate metal salts wherein the metal is present in stoichiometrically larger amounts than the organic acid radical. Such materials are usually referred to as "overbased" detergents, or by similar terms such as superbased or hyperbased detergents. Commonly employed methods for preparing the overbased salts involve heating a mineral oil solution of an acid with a stoichiometric excess of a metal neutralizing agent such as the metal oxide, hydroxide, carbonate, bicarbonate, or sulfide at a moderate reaction temperature in the range of about 40° to about 100° C., treating the mixture with an acidic gaseous substance, and filtering the resulting mass. The use of a "promoter" to aid the incorporation of a large excess of metal in the product likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, ethylene glycol, ethylene glycol monoalkyl ethers, diethylene glycol monoalkyl ethers, stearyl alcohol, and cyclohexyl alcohol; and amines such as aniline, phenylenediamine, phenothiazine, phenyl-β-naphthylamine, and dodecylamine. A particularly effective method for preparing the basic salts comprises mixing an acid with an excess of a basic alkali or alkaline earth metal neutralizing agent and at least one alcohol promoter, and carbonating the mixture at an elevated temperature such as 60°–200° C.

Examples of suitable metal-containing detergents include, but are not limited to, the neutral, low-base and overbased phenates and sulfurized phenates (phenol sulfides) of lithium, sodium, potassium, calcium, and magnesium wherein each aromatic group has one or more aliphatic groups to impart hydrocarbon solubility; the neutral, low-base and overbased sulfonates of lithium, sodium, potassium, calcium, and magnesium wherein each sulfonic acid moiety is attached to a long chain aliphatic group, or to a cycloaliphatic or aromatic nucleus which in turn usually contains one or more aliphatic substituents to impart hydrocarbon solubility; lithium, sodium, potassium, calcium and magnesium salts of aliphatic carboxylic acids and aliphatic-substituted cycloaliphatic carboxylic acids; and many other similar alkali and alkaline earth metal salts of oil-soluble organic acids such as the salicylates and succinates in which the acid moiety contains at least one aliphatic substituent (e.g. an alkyl or alkenyl group) of sufficient chain length to render the compound oil soluble. Mixtures of overbased salts of two or more different alkali and/or alkaline earth metals can be used. Likewise, basic or overbased salts of mixtures of two or more different acids or two or more different types of acids (e.g., one or more calcium phenates with one or more calcium sulfonates) can also be used. While rubidium, cesium and strontium salts are feasible, their expense renders them less preferred for most uses. Likewise, while barium salts are effective, the status of barium as a heavy metal under a toxicological cloud renders barium salts less preferred for present-day usage.

As is well known, overbased metal detergents are generally regarded as containing overbasing quantities of inorganic bases, probably in the form of micro dispersions or colloidal suspensions. Thus the term "oil-soluble" as applied to the metal-containing detergent materials is intended to include metal detergents wherein inorganic bases are present that are not necessarily completely or truly oil-soluble in the strict sense of the term, inasmuch as such detergents when mixed into base oils behave in much the same way as if they were fully and totally dissolved in the oil.

Collectively, the various basic or overbased detergents referred to hereinabove, have sometimes been called, quite simply, basic alkali metal or alkaline earth metal-containing organic acid salts.

Methods for the production of neutal, low-base and overbased alkali and alkaline earth metal-containing detergents are well known to those skilled in the art and are extensively reported in the patent literature. See, for example, the disclosures of U.S. Pat. Nos. 2,451,345; 2,451,346; 2,485,861; 2,501,731; 2,501,732; 2,585,520; 2,671,758; 2,616,904; 2,616,905; 2,616,906; 2,616,911; 2,616,924; 2,616,925; 2,617,049; 2,695,910; 3,178,368; 3,367,867; 3,496,105; 3,629,109; 3,865,737; 3,907,691; 4,100,085; 4,129,589; 4,137,184; 4,148,740; 4,212,752; 4,617,135; 4,647,387; 4,797,217; 4,880,550; and 5,013,463.

Dithiophosphate material

Preferred compositions of this invention contain at least one oil-soluble dithiophosphate material, i.e., one or more salts of hydrocarbyl dithiophosphates. Such materials are usually prepared by reacting phosphorus pentasulfide with one or more alcohols or phenolic compounds or diols to produce a hydrocarbyl dithiophosphoric acid which is then neutralized with one or more bases, such as an amine to form an amine salt of the dithiophosphoric acid or a metal base to form a metal salt of the dithiophosphoric acid. When a monohydric alcohol or phenol is used in forming the dithiophosphoric acid, a dihydrocarbyl dithiophosphoric acid is formed. On the other hand, when a suitable diol (e.g., 2,4-pentanediol) is used in this reaction, a cyclic hydrocarbyl dithiophosphoric acid is produced. See, for example, U.S. Pat. No. 3,089,850. Thus typical oil-soluble metal hydrocarbyl dithiophosphates used as component a) may be represented by the formula

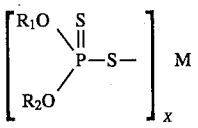

where $R_1$ and $R_2$ are, independently, hydrocarbyl groups or taken together are a single hydrocarbyl group forming a cyclic structure with the phosphorus and two oxygen atoms, preferably a hydrocarbyl-substituted trimethylene group of sufficient carbon content to render the compound oil soluble, M is a metal or a nitrogen base such as an amine, and x is an integer corresponding to the valence of M. The preferred compounds are those in which $R_1$ and $R_2$ are separate hydrocarbyl groups (i.e., the salts of dihydrocarbyl dithiophosphoric acids). Usually each hydrocarbyl group of the dithiophosphate materials will contain no more than about 50 carbon atoms although even higher molecular weight hydrocarbyl groups can be present in the compound. The hydrocarbyl groups include cyclic and acyclic groups, both saturated and unsaturated, such as alkyl, cycloalkyl, alkenyl, cycloalkenyl, aryl, cycloalkylalkyl, aralkyl, and the like. It will be understood that the hydrocarbyl groups may contain elements other than carbon and hydrogen provided such other elements do not detract from the predominantly hydrocarbonaceous character of the hydrocarbyl group. Thus the hydrocarbyl groups may contain ether oxygen atoms, thioether sulfur atoms, secondary or tertiary amino nitrogen atoms, and/or inert functional groups such as esterified carboxylic groups, keto groups, thioketo groups, and the like.

The metals present in the oil-soluble metal dihydrocarbyl dithiophosphates and oil-soluble metal cyclic hydrocarbyl dithiophosphates include such metals as lithium, sodium, potassium, copper, magnesium, calcium, zinc, strontium, cadmium, barium, mercury, aluminum, tin, lead, chromium, molybdenum, tungsten, manganese, iron, cobalt, nickel, ruthenium, etc., as well as combinations of two or more such metals. Of the foregoing, the salts containing group II metals, aluminum, lead, tin, molybdenum, manganese, cobalt, and/or nickel, are preferred. The dihydrocarbyl dithiophosphates of zinc and copper are particularly preferred, with the zinc salts being the most preferred for use in the practice of this invention.

The phosphorodithioic acids from which the metal salts are formed can be prepared by the reaction of about 4 moles of one or more alcohols (cyclic or acyclic) or one or more phenols or mixture of one or more alcohols and one or more phenols (or about 2 moles of one or more diols) per mole of phosphorus pentasulfide, and the reaction may be carried out within a temperature range of from about 50° to about 200° C. The reaction generally is completed in about 1 to 10 hours. Hydrogen sulfide is liberated during the reaction.

Other methods for the preparation of the phosphorodithioic acids are known, and if suitable, can be used. Note, for example, PCT International Publication No. WO 90/07512, which describes reaction of one or more alcohols and/or one or more phenols with phosphorus sesquisulfide in the presence of sulfur at an elevated temperature, preferably in the range of 85°–150° C. with an overall atomic P:S ratio of at least 2.5:1.

The alcohols used in forming the phosphorodithioic acids by either of the above methods are preferably primary alcohols, or secondary alcohols. Mixtures thereof are also suitable. The primary alcohols include propanol, butanol, isobutyl alcohol, pentanol, 2-ethyl-1-hexanol, isooctyl alcohol, nonanol, decanol, undecanol, dodecanol, tridecanol, tetradecanol, octadecanol, eicosanol, and the like. The primary alcohols may contain various substituent groups such as halogen atoms, nitro groups, etc., which do not interfere with the desired reaction. Among suitable secondary alcohols are included 2-butanol, 2-pentanol, 3-pentanol, 2-hexanol, 5-methyl-2-hexanol, and the like. In some cases, it is preferable to utilize mixtures of various alcohols, such as mixtures of 2-propanol with one or more higher molecular weight primary alcohols, especially primary alcohols having from 4 to about 13 carbon atoms in the molecule. Such mixtures preferably contain at least 10 mole percent of 2-propanol, and usually will contain from about 20 to about 90 mole percent of 2-propanol. In one preferred embodiment, the alcohol comprises about 30 to 50 mole percent of 2-propanol, about 30 to 50 mole percent isobutyl alcohol and about 10 to 30 mole percent of 2-ethyl-l-hexanol.

Other suitable mixtures of alcohols include 2-propanol/butanol; 2-propanol/2-butanol; 2-propanol/2-ethyl-1-hexanol; butanol/2-ethyl-1-hexanol; isobutyl alcohol/2-ethyl-1-hexanol; and 2-propanol/tridecanol.

Cycloaliphatic alcohols suitable for use in the production of the phosphorodithioic acids include cyclopentanol, cyclohexanol, methylcyclohexanol, cyclooctanol, borneol and the like. Preferably, such alcohols are used in combination with one or more primary alkanols such as butanol, isobutyl alcohol, or the like.

Illustrative phenols which can be employed in forming the phosphorodithioic acids include phenol, o-cresol, m-cresol, p-cresol, 4-ethylphenol, 2,4-xylenol, and the like. It is desirable to employ phenolic compounds in combination with primary alkanols such propanol, butanol, hexanol, or the like.

Other alcohols which can be employed include benzyl alcohol, cyclohexenol, and their ring-alkylated analogs.

It will be appreciated that when mixtures of two or more alcohols and/or phenols are employed in forming the phosphorodithioic acid, the resultant product will normally comprise a mixture of three or more different dihydrocarbyl phosphorodithioic acids, usually in the form of a statistical distribution in relation to the number and proportions of alcohols and/or phenols used.

Illustrative diols which can be used in forming the phosphorodithioic acids include 2,4-pentanediol, 2,4-hexanediol, 3,5-heptanediol, 7-methyl-2,4-octanediol, neopentyl glycol, 2-butyl-1,3-propanediol, 2,2-diethyl-1,3-propanediol, and the like.

The preparation of the metal salts of the dihydrocarbyl dithiophosphoric acids or the cyclic hydrocarbyl dithiophosphoric acids is usually effected by reacting the acid product with a suitable metal compound such as a metal carbonate, metal hydroxide, metal alkoxide, metal oxide, or other appropriate metal salt. Simply mixing and heating such reactants is normally sufficient to cause the reaction to occur and the resulting product is usually of sufficient purity for use in the practice of this invention. Typically, the salts are formed in the presence of a diluent such as an alcohol, water or a light mineral oil. Neutral salts are prepared by reacting one equivalent of metal oxide or hydroxide with one equivalent of the acid. Basic metal salts are prepared by adding an excess (i.e., more than one equivalent) of the metal oxide or hydroxide with one equivalent of the dihydrocarbyl phosphorodithioic acid or cyclic hydrocarbyl phosphorodithioic acid.

Illustrative metal compounds which may be used in such reactions include calcium oxide, calcium hydroxide, silver oxide, silver carbonate, magnesium oxide, magnesium hydroxide, magnesium carbonate, magnesium ethoxide, zinc oxide, zinc hydroxide, strontium oxide, strontium hydroxide, cadmium oxide, cadmium hydroxide, cadmium carbonate, barium oxide, aluminum oxide, aluminum propoxide, iron carbonate, copper hydroxide, lead oxide, tin butoxide, cobalt oxide, nickel hydroxide, manganese oxide, and the like.

In some cases, incorporation of certain ingredients such as small amounts of metal acetate or acetic acid in conjunction with the metal reactant will facilitate the reaction and provide an improved product. For example, use of up to about 5% of zinc acetate in combination with the required amount of zinc oxide tends to facilitate the formation of zinc dihydrocarbyl dithiophosphates.

Examples of useful metal salts of dihydrocarbyl dithiophosphoric acids, and methods for preparing such salts are found in the prior art such as for example, U.S. Pat. Nos. 4,263,150; 4,289,635; 4,308,154; 4,322,479; 4,417,990; and 4,466,895.

Generally speaking, the preferred types of metal salts of dihydrocarbyl dithiophosphoric acids are the oil-soluble metal salts of dialkyl dithiophosphoric acids. Such compounds generally contain alkyl groups having at least three carbon atoms, and preferably the alkyl groups contain up to 10 carbon atoms although as noted above, even higher molecular weight alkyl groups are entirely feasible. A few illustrative zinc dialkyl dithiophosphates include zinc diisopropyl dithiophosphate, zinc dibutyl dithiophosphate, zinc diisobutyl dithiophosphate, zinc di-sec-butyl dithiophosphate, the zinc dipentyl dithiophosphates, the zinc dihexyl dithiophosphates, the zinc diheptyl dithiophosphates, the zinc dioctyl dithiophosphates, the zinc dinonyl dithiophosphates, the zinc didecyl dithiophosphates, and the higher homologs thereof. Mixtures of two or more such metal compounds are often preferred for use such as metal salts of dithiophosphoric acids formed from mixtures of isopropyl alcohol and secondary butyl alcohol; isopropyl alcohol, isobutyl alcohol, and 2-ethylhexyl alcohol; isopropyl alcohol, butyl alcohol, and pentyl alcohol; isobutyl alcohol and octyl alcohol; and the like.

The preparation of the organic salts of organic dithiophosphoric acids usually involves reacting an appropriate dithiophosphoric acid product with a suitable nitrogen base such as an amine. The amines used can be cyclic or acyclic, and typically they are primary or secondary amines. The chief requirements are that the amine have sufficient basicity to neutralize the dithiophosphoric acid being used, and that the resultant salt have sufficient oil solubility to be useable in the practice of this invention. The amine reactant is employed in an amount sufficient to neutralize the dithiophosphoric acid being used. Usually, relatively mild reaction temperatures (e.g., room temperature up to about 100° C.) are sufficient to cause the neutralization reaction between the amine and the dithiophosphoric acid to take place at a suitable reaction rate. For further details, reference may be had, for example, to U.S. Pat. No. 3,637,499.

Antioxidants

Preferably the compositions will contain a sufficient amount of one or more oil-soluble antioxidants in order to protect the composition from premature degradation in the presence of air, especially at elevated temperatures. Typical antioxidants include secondary aromatic amine antioxidants, hindered phenolic antioxidants, methylene-bridged phenolic antioxidants, sulfurized phenolic antioxidants, sulfurized α-olefin antioxidants, copper-containing antioxidant compounds, phosphorus-containing antioxidants, and the like.

Illustrative sterically hindered phenolic antioxidants include ortho-alkylated phenolic compounds such as 2,6-di-tert-butylphenol, 4-methyl-2,6-di-tert-butylphenol, 2,4,6-tri-tert-butylphenol, 2-tert-butylphenol, 2,6-diisopropylphenol, 2-methyl-6-tert-butylphenol, 2,4-dimethyl-6-tert-butylphenol, 4-(N,N-dimethylaminomethyl)-2,6-di-tert-butylphenol, 4-ethyl-2,6-di-tert-butylphenol, 2-methyl-6-styrylphenol, 2,6-di-styryl-4-nonylphenol, and their analogs and homologs. Mixtures of two or more such mononuclear phenolic compounds are also suitable.

Another groups of antioxidants for use in the compositions of this invention are methylene-bridged alkylphenols, and these can be used singly or in combinations with each other, or in combinations with sterically-hindered unbridged phenolic compounds. Illustrative methylene bridged compounds include 4,4'-methylenebis(6-tert-butyl-o-cresol), 4,4'-methylenebis(2-tert-amyl-o-cresol), 2,2'-methylenebis(4-methyl-6-tert-butylphenol), 4,4'-methylenebis(2,6-di-tert-butylphenol), and similar compounds. Also useful are mixtures of methylene-bridged alkylphenols such as are described in U.S. Pat. No. 3,211,652.

Amine antioxidants, especially oil-soluble aromatic secondary amines can also be used in the compositions of this invention. Aromatic secondary monoamines are preferred. However, aromatic secondary polyamines are also suitable. Illustrative aromatic secondary monoamines include diphenylamine, alkyl diphenylamines containing 1 or 2 alkyl substituents each having up to about 16 carbon atoms, phenyl-α-naphthylamine, phenyl-β-naphthylamine, alkyl- or aralkyl-substituted phenyl-α-naphthylamine containing one or two alkyl or aralkyl groups each having up to about 16 carbon atoms, alkyl- or aralkyl-substituted phenyl-β-naphthylamine containing one or two alkyl or aralkyl groups each having up to about 16 carbon atoms, and similar compounds.

A preferred type of aromatic amine antioxidant is an alkylated diphenylamine of the general formula

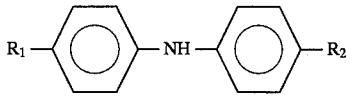

wherein $R_1$ is an alkyl group (preferably a branched alkyl group) having 8 to 12 carbon atoms, (more preferably 8 or 9 carbon atoms) and $R_2$ is a hydrogen atom or an alkyl group (preferably a branched alkyl group) having 8 to 12 carbon atoms, (more preferably 8 or 9 carbon atoms). Most preferably, $R_1$ and $R_2$ are the same. One such preferred compound is available commercially as Naugalube 438L, a material which is understood to be predominantly a 4,4'-dinonyldiphenylamine (i.e., bis(4-nonylphenyl)amine) wherein the nonyl groups are branched.

Another useful type of antioxidant for inclusion in the compositions of this invention is comprised to one or more sulfurized phenolic compounds such as are prepared by reacting sulfur, sulfur monochloride or sulfur dichloride with an alkylphenol or mixture of alkylphenols. Suitable commercially available materials of this type include HiTEC® 619 additive (Ethyl Petroleum Additives, Inc.) and ECA 8743 additive (Exxon Chemical Co.).

Mixtures of different antioxidants can also be used. One suitable mixture is comprised of a combination of (i) an oil-soluble mixture of at least three different sterically-hindered tertiary butylated monohydric phenols which is in the liquid state at 25° C., (ii) an oil-soluble mixture of at least three different sterically-hindered tertiary butylated methylene-bridged polyphenols, and (iii) at least one bis(4-alkylphenyl)amine wherein the alkyl group is a branched alkyl group having 8 to 12 carbon atoms, the proportions of (i), (ii) and (iii) on a weight basis falling in the range of 3.5 to 5.0 parts of component (i) and 0.9 to 1.2 parts of component (ii) per part by weight of component (iii).

As noted above, preferably the antioxidant comprises at least one secondary aromatic amine antioxidant. Most preferably the lubricant or additive concentrate additionally contains one or more additional antioxidants such as (i) at least one oil-soluble sulfurized olefin having about 10 to about 30 carbon atoms in the molecule (preferably an average of about 16 to about 24 carbon atoms per molecule), and a sulfur content of about 15 to 25 wt %; and/or (ii) at least one oil-soluble sulfurized phenol having about 25 to about 100 carbon atoms in the molecule (preferably an average of about 50 to about 70 carbon atoms per molecule), and a sulfur content of about 5 to 15 wt %; and/or (iii) an oil-soluble phenolic antioxidant, preferably an oil-soluble hindered phenolic antioxidant; and/or (iv) an oil-soluble copper-containing antioxidant.

On an active ingredient basis, the antioxidants are typically used in the finished lubricating oils in amounts within the range of about 0.01 to about 5 wt %, and more preferably in the range of about 0.1 to about 2 wt %, based on the total weight of the finished lubricant.

Demulsifiers

Demulsifier(s) which can be used, and preferably are used, in the compositions of this invention can likewise be varied. These include oxyalkylated polyols, oxyalkylated phenol-formaldehyde condensation products, oxyalkylated polyamines, alkyl benzene sulfonates, polyethylene oxides, polypropylene oxides, block copolymers of ethylene oxide and propylene oxide, amine glycol condensates, salts and esters of oil soluble acids, and the like.

For example, use can be made of oxyalkylated trimethylol alkanes with molecular weights in the range of 1,000 to 10,000, and preferably in the range of 3,000 to 8,000. Preferably, the oxyalkylated trimethylol alkane is an oxyalkylated trimethylol ethane or propane, especially where the oxyalkylene groups are composed of a mixture of propyleneoxy and ethylenoxy groups and where these groups are so disposed as to form relatively hydrophobic blocks adjacent the trimethylol group and relatively hydrophilic blocks remote the trimethylol group. Typical oxyalkylated trimethylol propane demulsifiers are described in U.S. Pat. No. 3,101,374. Commercially available products of this type are available from BASF Corporation under the Pluradot trademark. They are available in various molecular weights. Pluradot HA-510 has an average molecular weight of 4,600 and Pluradot HA-530 has an average molecular weight of about 5,300. Pluradot additives are propoxylated and ethoxylated trimethylol propanes.

Another type of suitable demulsifiers are oxyalkylated alkyl phenol-formaldehyde condensation products. Typically, these products have molecular weights in the range of about 4,000 to about 6,000 and are comprised of lower alkyl substituted phenol moieties joined together by methylene groups and in which the hydroxyl groups of the phenolic moieties have been ethoxylated. One such commercial product is marketed by Ceca S. A. of Paris, France under the "Prochinor GR77" trade name. The product is supplied as a concentrate in an aromatic solvent and the active ingredient is believed to be an ethoxylated nonylphenol-formaldehyde condensate of molecular weight 4,200 (by gel permeation chromatography calibrated with polystyrene).

Another suitable type of demulsifier is comprised of the tetra-polyoxyalkylene derivatives of ethylene diamine, especially the tetra-poly(oxyethylene)-poly(oxypropylene) derivatives of ethylene diamine. Materials of this type are available commercially from BASF Corporation under the "Tetronics" trademark. Materials of this general type are described in U.S. Pat. No. 2,979,528.

Mixtures of alkylaryl sulfonates, polyoxyalkylene glycols and oxyalkylated alkylphenolic resins, such as are available commercially from Petrolite Corporation under the TOLAD trademark, are also suitable. One such proprietary product, identified as TOLAD 286K, is understood to be a mixture of these components dissolved in a solvent composed of alkyl benzenes. TOLAD 286 is believed to be a similar product wherein the solvent is composed of a mixture of heavy aromatic naphtha and isopropyl alcohol. One preferred demulsifier is a proprietary product available from the Petrolite Corporation under the trade designation TOLAD 326 additive.

Also useful as demulsifiers are proprietary materials available from BASF Corporation under the Pluronic and Pluradyne trademarks. These are believed to be block copolymers of propylene oxide and ethylene oxide.

Suitable amine glycol condensates are available under the TRITON trademark of Rohm & Haas Company. One such material of this type is TRITON CF-32 which is described by the manufacturer as composed of 95% active component(s) and 5% water which is a pale yellow liquid having a Brookfield viscosity at 25° C. of 550 cP, a specific gravity of 1.03 at 25° C., a density of 8.6 lb/gal, a pH (5% aqueous solution) of 9.5–11, a flash point (TOC) of <300° F., and a pour point of 15° F. (–9° C.).

Corrosion inhibitors

It is also preferred pursuant to this invention to employ in the lubricant compositions and additive concentrates a suitable quantity of a corrosion or rust inhibitor. This may be a single compound or a mixture of compounds having the property of inhibiting corrosion or rusting of metallic surfaces.

One type of such additives are inhibitors of copper corrosion. Such compounds include thiazoles, triazoles and thiadiazoles. Examples of such compounds include benzotriazole, tolyltriazole, octyltriazole, decyltriazole, dodecyltriazole, 2-mercaptobenzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-(bis)hydrocarbyldithio)-1,3,4-thiadiazoles. The preferred compounds are the 1,3,4-thiadiazoles, a number of which are available as articles of commerce. Such compounds are generally synthesized from hydrazine and carbon disulfide by known methods. See for example U.S. Pat. Nos. 2,765,289; 2,749,311; 2,760,933; 2,850,453; 2,910,439; 3,663,561; 3,862,798; and 3,840,549.

Other types of corrosion inhibitors suitable for use in the compositions of this invention include dimer and trimer acids, such as are produced from tall oil fatty acids, oleic acid, linoleic acid, or the like. Products of this type are currently available from various commercial sources, such as, for example, the dimer and trimer acids sold under the HYSTRENE trademark by the Humco Chemical Division of Witco Chemical Corporation and under the EMPOL trademark by Emery Chemicals. Another useful type of corrosion inhibitor for use in the practice of this invention are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable corrosion inhibitors include aminosuccinic acid derivatives; ether amines; acid phosphates; amines; polyethoxylated compounds such as ethoxylated amines, ethoxylated phenols, and ethoxylated alcohols; imidazolines; and the like. Materials of these types are known to those skilled in the art and a number of such materials are available as articles of commerce. One very suitable commercially-available rust inhibitor is HiTEC® 029 additive (Ethyl Petroleum Additives, Inc.).

The lubricant compositions of this invention most preferably contain from 0.005 to 0.5% by weight, and especially from 0.01 to 0.2% by weight, of one or more corrosion inhibitors of the type described above.

Antifoam agents

Suitable antifoam agents include silicones and organic polymers such as acrylate polymers. Various antifoam agents are described in *Foam Control Agents* by H. T. Kerner (Noyes Data Corporation, 1976, pages 125–176), the disclosure of which is incorporated herein by reference. Mixtures of silicone-type antifoam agents such as the liquid dialkyl silicone polymers with various other substances are also effective. Typical of such mixtures are silicones mixed with an acrylate polymer, silicones mixed with one or more amines, and silicones mixed with one or more amine carboxylates.

The antifoam agent is employed in amount sufficient to inhibit foam formation in the finished lubricant. Such amount is usually quite small, e.g., in the range of from about 0.005 to about 0.5 wt %, although greater or lesser amounts can be used if and when the circumstances warrant departures from this range.

Supplemental antiwear and/or extreme pressure additives

If desired, the compositions of this invention may contain one or more oil-soluble supplemental antiwear and/or extreme pressure additives. These comprise a number of well known classes of materials including, for example, sulfur-containing additives, esters of boron acids, esters of phosphorus acids, amine salts of phosphorus acids and acid esters, higher carboxylic acids and derivatives thereof, chlorine-containing additives, and the like.

Typical sulfur-containing antiwear and/or extreme pressure additives include dihydrocarbyl polysulfides; sulfurized olefins; sulfurized fatty acid esters of both natural (e.g. sperm oil) and synthetic origins; trithiones; thienyl derivatives; sulfurized terpenes; sulfurized oligomers of $C_2$–$C_8$ monoolefins; xanthates of alkanols and other organo-hydroxy compounds such as phenols; thiocarbamates made from alkyl amines and other organo amines; and sulfurized Diels-Alder adducts such as those disclosed in U.S. Pat. No. Re. 27,331. Specific examples include sulfurized polyisobutene of Mn 1,100, sulfurized isobutylene, sulfurized triisobutene, dicyclohexyl disulfide, diphenyl and dibenzyl disulfide, di-tert-butyl trisulfide, and dinonyl trisulfide, among others.

Esters of boron acids which may be used include borate, metaborate, pyroborate and biborate esters of monohydric and/or polyhydric alcohols and/or phenols, such as trioctyl borate, tridecyl borate, 2-ethylhexyl pyroborate, isoamyl metaborate, trixylyl borate, (butyl)(2,4-hexanediyl)borate, and the like.

Typical esters of phosphorus acids which may be used as antiwear and/or extreme pressure additives include trihydrocarbyl phosphites, phosphonates and phosphates, and dihydrocarbyl phosphites; such as tricresyl phosphate, tributyl phosphite, tris(2-chloroethyl)phosphate and phosphite, dibutyl trichloromethyl phosphonates, di(n-butyl)phosphite, triphenyl phosphite, and tolyl phosphinic acid dipropyl ester.

Among the amine salts of phosphorus acids and phosphorus acid-esters which can be employed are amine salts of partially esterified phosphoric, phosphorous, phosphonic, and phosphinic acids and their partial or total thio analogs such as partially esterified monothiophosphoric, dithiophosphoric, trithiophosphoric and tetrathiophosphoric acids; amine salts of phosphonic acids and their thio analogs; and the like. Specific examples include the dihexylammonium salt of dodecylphosphoric acid, the diethyl hexyl ammonium salt of dioctyl dithiophosphoric acid, the octadecylammonium salt of dibutyl thiophosphoric acid, the dilaurylammonium salt of 2-ethylhexylphosphoric acid, the dioleyl ammonium salt of butane phosphonic acid, and analogous compounds.

Higher carboxylic acids and derivatives which can be used as antiwear and/or extreme pressure additives are illustrated by fatty acids, dimerized and trimerized unsaturated natural acids (e.g., linoleic) and esters, amine, ammonia, and metal (particularly lead) salts thereof, and amides and imidazoline salt and condensation products thereof, oxazolines, and esters of fatty acids, such as ammonium di-(linoleic) acid, lard oil, oleic acid, animal glycerides, lead stearate, etc.

Suitable chlorine-containing additives include chlorinated waxes of both the paraffinic and microcrystalline type, polyhaloaromatics such as di- and trichlorobenzene, trifluoromethyl naphthalenes, perchlorobenzene, pentachlorophenol and dichloro diphenyl trichloroethane. Also useful are chlorosulfurized olefins and olefinic waxes and sulfurized chlorophenyl methyl chlorides and chloroxanthates. Specific examples include chlorodibenzyl disulfide, chlorosulfurized polyisobutene of $\bar{M}n$ 600, chlorosulfurized pinene and chlorosulfurized lard oil.

On an active ingredient basis, supplemental antiwear and/or extreme pressure additives such as the foregoing, if used, are typically used in amounts such that the finished lubricant contains in the range of 0.001 to 5 wt % of one or more such additives.

Supplemental ashless dispersants

If desired, the compositions of this invention can include one or more supplemental ashless dispersants in order to supplement the dispersancy contributed by components a) and b). The supplemental ashless dispersant(s) will of course differ from components a) and b) in chemical composition. Examples include long chain hydrocarbyl polyamine dispersants and Mannich polyamine dispersants. Such dispersants can be post-treated with various post-treating agents in accordance with known technology. See, for example, a representative listing of post-treating agents set forth in Table 4 of U.S. Pat. No. 5,137,980.

It will be appreciated that the term "ashless" as used herein does not mean that the dispersant leaves no residues on engines parts with which the lubricant comes in contact. Rather, it means that the dispersant does not itself contain metal. The dispersant may, however, have a phosphorus or boron content, as these elements are not metals.

The oil-soluble long-chain polyamine dispersants generally comprise one or more polyamine moieties suitably linked to a long chain polymeric hydrocarbon. Such long chain polyamine dispersants and their preparation are described, for example, in U.S. Pat. Nos. 3,275,554; 3,438,757; 3,454,555; 3,565,804; 3,671,511; 3,821,302; and 3,394,576.

Mannich base dispersants are typically products formed by reaction among one or more polyamines, formaldehyde and a hydrocarbyl phenol in which the hydrocarbyl substituent is a hydrogenated or unhydrogenated polyolefin group and preferably a polypropylene or polyisobutene group having a number average molecular weight (as measured by gel permeation chromatography) of from 250 to 10,000, and more preferably from 500 to 5,000, and most preferably from 750 to 2,500. Details concerning synthesis of Mannich base dispersants are set forth, for example, in U.S. Pat. Nos. 2,459,112; 2,962,442; 2,984,550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,980,569; and 4,011,380.

If used, the amount of such supplemental ashless dispersants will typically be such that the finished lubricant will contain in the range of 0.01 to about 5 wt % of such supplemental dispersants.

Pour point depressants

Another useful type of additive included in compositions of this invention is one or more pour point depressants. Pour point depressants have the property of improving the low temperature properties of oil-base compositions. Suitable materials are referred to, for example, in the books *Lubricant Additives* by C. V. Smalheer and R. Kennedy Smith (Lezius-Hiles Co. Publishers, Cleveland, Ohio, 1967); *Gear and Transmission Lubricants* by C. T. Boner (Reinhold Publishing Corp., New York, 1964); and *Lubricant Additives* by M. W. Ranney (Noyes Data Corporation, New Jersey, 1973). Among the types of compounds which function satisfactorily as pour point depressants in the compositions of this invention are polymethacrylates, polyacrylates, condensation products of haloparaffin waxes and aromatic compounds, and vinyl carboxylate polymers. Also useful as pour point depressants are terpolymers made by polymerizing a dialkyl fumarate, vinyl ester of a fatty acid and a vinyl alkyl ether. Techniques for preparing such polymers and their uses are disclosed in U.S. Pat. No. 3,250,715. Generally, when they are present in the compositions of this invention, the pour point depressants (on an active content basis) are present in amounts within the range of 0.01 to 5, and more often within the range of 0.01 to 1, weight percent of the total composition.

Viscosity index improvers

Depending upon the viscosity grade required, the lubricant compositions can contain up to 15 weight percent of one or more viscosity index improvers (excluding the weight of solvent or carrier fluid with which viscosity index improvers are often associated as supplied). Among the numerous types of materials known for such use are hydrocarbon polymers grafted with, for example, nitrogen-containing polymers, olefin polymers such as polybutene, ethylene-propylene copolymers, hydrogenated polymers and copolymers and terpolymers of styrene with isoprene and/or butadiene, polymers of alkyl acrylates or alkyl methacrylates, copolymers of alkyl methacrylates with N-vinyl pyrrolidone or dimethylaminoalkyl methacrylate; post-grafted polymers of ethylene-propylene with an active monomer such as maleic anhydride which may be further reacted with an alcohol or an alkylene polyamine; styrene/maleic anhydride polymers post-treated with alcohols and/or amines, and the like.

Dispersant viscosity index improvers, which combine the activity of dispersants and viscosity index improvers, suitable for use in the compositions of this invention are described, for example, in U.S. Pat. Nos. 3,702,300; 4,068,056; 4,068,058; 4,089,794; 4,137,185; 4,146,489; 4,149,984; 4,160,739; and 4,519,929. Dispersant viscosity index improvers which additionally possess antioxidant properties are also known and reported in the patent literature, and can be employed in the compositions of this invention.

Friction reducers

These materials, sometimes known as fuel economy additives, include such substances as the alkyl phosphonates as disclosed in U.S. Pat. No. 4,356,097, aliphatic hydrocarbyl-substituted succinimides derived from ammonia or alkyl monoamines as disclosed in European Patent Publication No. 20037, dimer acid esters as disclosed in U.S. Pat. No. 4,105,571, oleamide, and partial fatty acid esters of polyhydroxy compounds such as glycerol monooleate and pentaerythritol monooleate. Such additives, when used are generally present in amounts within in the range of 0.1 to 5 weight percent. Glycerol oleates are usually present in amounts in the range of about 0.05 to about 1.0 weight percent based on the weight of the formulated oil.

Other suitable friction reducers include aliphatic amines or ethoxylated aliphatic amines, aliphatic fatty acid amides, aliphatic carboxylic acids, aliphatic carboxylic esters, aliphatic carboxylic ester-amides, aliphatic phosphates, aliphatic thiophosphonates, aliphatic thiophosphates, etc., wherein the aliphatic group usually contains above about eight carbon atoms so as to render the compound suitably oil soluble.

Proportions

It will be understood from the foregoing that whatever components are selected for use in the compositions of this invention, each component will be present in an amount at least sufficient for it to exert its intended function or functions in the finished lubricant composition.

Base Oils

The lubricant compositions of this invention may be formed from natural (e.g., mineral or vegetable oils) or synthetic base oils, or blends thereof.

Suitable mineral oils include those of appropriate viscosity refined from crude oil of any source including Gulf Coast, Midcontinent, Pennsylvania, California, Alaska, Middle East, North Sea and the like. Standard refinery operations may be used in processing the mineral oil. Among the general types of petroleum oils useful in the compositions of this invention are solvent neutrals, bright stocks, cylinder stocks, residual oils, hydrocracked base stocks, paraffin oils including pale oils, and solvent extracted naphthenic oils. Such oils and blends of them are produced by a number of conventional techniques which are widely known by those skilled in the art.

Among the suitable synthetic oils are homo- and interpolymers of $C_2$–$C_{12}$ olefins, carboxylic acid esters of both monoalcohols and polyols, polyethers, silicones, polyglycols, silicates, alkylated aromatics, carbonates, thiocarbonates, orthoformates, phosphates and phosphites, borates and halogenated hydrocarbons. Representative of such oils are homo- and interpolymers of $C_2$–$C_{12}$ monoolefinic hydrocarbons, alkylated benzenes (e.g., dodecyl benzenes, didodecyl benzenes, tetradecyl benzenes, dinonyl benzenes, di-(2-ethylhexyl)benzenes, wax-alkylated naphthalenes); and polyphenyls (e.g., biphenyls, terphenyls).

Alkylene oxide polymers and interpolymers and derivatives thereof where the terminal hydroxyl groups have been modified by esterification, etherification, etc., constitute another class of synthetic oils. These are exemplified by the oils prepared through polymerization of alkylene oxides such as ethylene oxide or propylene oxide, and the alkyl and aryl ethers of these polyoxyalkylene polymers (e.g., methyl polyisopropylene glycol ether having an average molecular weight of 1,000, diphenyl ether of polyethylene glycol having a molecular weight of 500–1,000, diethyl ether of polypropylene glycol having a molecular weight of 1,000–1,500) or mono- and poly-carboxylic esters thereof, for example, the acetic acid ester, mixed $C_3$–$C_6$ fatty acid esters, or the $C_{13}$ Oxo acid diester of tetraethylene glycol.

Another suitable class of synthetic oils comprises the esters of dicarboxylic acids (e.g., phthalic acid, succinic acid, maleic acid, azelaic acid, suberic acid, sebacic acid, fumaric acid, adipic acid, linoleic acid dimer) with a variety of alcohols (e.g., butyl alcohol, hexyl alcohol, dodecyl alcohol, 2-ethylhexyl alcohol, ethylene glycol). Specific examples of these esters include dibutyl adipate, di(2-ethylhexyl) adipate, didodecyl adipate, di(tridecyl) adipate, di(2-ethylhexyl) sebacate, dilauryl sebacate, di-n-hexyl fumarate, dioctyl sebacate, diisooctyl azelate, diisodecyl azelate, dioctyl phthalate, didecyl phthalate, di(eicosyl) sebacate, the 2-ethylhexyl diester of linoleic acid dimer, and the complex ester formed by reacting one mole of sebacic acid with two moles of tetraethylene glycol and two moles of 2-ethylhexanoic acid.

Other esters which may be used include those made from $C_3$–$C_{18}$ monocarboxylic acids and polyols and polyol ethers such as neopentyl glycol, trimethylolpropane, pentaerythritol and dipentaerythritol. Trimethylol propane tripelargonate, pentaerythritol tetracaproate, the ester formed from trimethylolpropane, caprylic acid and sebacic acid, and the polyesters derived from a $C_4$–$C_{14}$ dicarboxylic acid and one or more aliphatic dihydric $C_3$–$C_{12}$ alcohols such as derived from azelaic acid or sebacic acid and 2,2,4-trimethyl-1,6-hexanediol serve as examples.

Silicon-based oils such as the polyalkyl-, polyaryl-, polyalkoxy-, or polyaryloxy-siloxane oils and silicate oils comprise another class of synthetic lubricants (e.g., tetraethyl silicate, tetraisopropyl silicate, tetra-(2-ethylhexyl) silicate, tetra-(p-tert-butylphenyl) silicate, poly(methyl)siloxanes, and poly(methylphenyl)siloxanes. Other synthetic lubricating oils include liquid esters of phosphorus-containing acids (e.g., tricresyl phosphate, trioctyl phosphate, triphenyl phosphite, and diethyl ester of decane phosphonic acid.

Also useful as base oils or as components of base oils are hydrogenated or unhydrogenated liquid oligomers of $C_6$–$C_{16}$ α-olefins, such as hydrogenated or unhydrogenated oligomers formed from 1-decene. Methods for the production of such liquid oligomeric 1-alkene hydrocarbons are known and reported in the literature. See for example U.S. Pat. Nos. 3,749,560; 3,763,244; 3,780,128; 4,172,855; 4,218,330; 4,902,846; 4,906,798; 4,910,355; 4,911,758; 4,935,570; 4,950,822; 4,956,513; and 4,981,578. Additionally, hydrogenated 1-alkene oligomers of this type are available as articles of commerce. Blends of such materials can also be used in order to adjust the viscometrics of the given base oil. As is well known, hydrogenated oligomers of this type contain little, if any, residual ethylenic unsaturation. Preferred oligomers are formed by use of a Friedel-Crafts catalyst (especially boron trifluoride promoted with water or a $C_{1-20}$ alkanol) followed by catalytic hydrogenation of the oligomer so formed using procedures such as are described in the foregoing U.S. patents.

Other catalyst systems which can be used to form oligomers of 1-alkene hydrocarbons, which, on hydrogenation, provide suitable oleaginous liquids include Ziegler catalysts such as ethyl aluminum sesquichloride with titanium tetrachloride, aluminum alkyl catalysts, chromium oxide catalysts on silica or alumina supports and a system in which a boron trifluoride catalyst oligomerization is followed by treatment with an organic peroxide.

Likewise, various proprietary synthetic lubricants such as KETJENLUBE synthetic oil of Akzo Chemicals can be employed either as the sole base lubricant or as a component of the base lubricating oil.

Typical vegetable oils that may be used as base oils or as components of the base oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, meadowfoam oil, and the like. Such oils may be partially or fully hydrogenated, if desired.

The fact that the base oils used in the compositions of this invention may be composed of (i) one or more mineral oils, (ii) one or more synthetic oils, (iii) one or more vegetable oils, or (iv) a blend of (i) and (ii), or (i) and (iii), or (ii) and (iii), or (i), (ii) and (iii) does not mean that these various types of oils are necessarily equivalents of each other. Certain types of base oils may be used in certain compositions for the specific properties they possess such as biodegradability, high temperature stability, non-flammability or lack of corrosivity towards specific metals (e.g. silver or cadmium). In other compositions, other types of base oils may be preferred for reasons of availability or low cost. Thus, the skilled artisan will recognize that while the various types of base oils discussed above may be used in the compositions of this invention, they are not necessarily functional equivalents of each other in every instance.

In the illustrative examples of finished lubricants of this invention set forth in Table I, component a) is HiTEC® 646 additive (Ethyl Petroleum Additives, Inc.), and component b) is HiTEC® 7714 additive (Ethyl Petroleum Additives, Inc.). These dispersants meet all of the respective parameters given above for components a) and b). Component a) is a mineral oil solution containing 60% of active ingredients and component b) is a mineral oil solution containing 40% of active ingredients. Components c-1) and c-2)are HiTEC® 7304 and 614 additives, respectively. These are low-base calcium alkylbenzene sulfonates, each having a nominal TBN below about 50. The term "Acrylic PPD" refers to a polymeric acrylic pour point depressant. The lubricants of Examples 1–4 and 6–20 are SAE 15W-40 lubricants, the lubricant of Example 5 is of grade SAE 30, and the lubricant of Example 21 is of grade SAE 10W-30.

TABLE I

Illustrative Compositions

| Components | Ex. 1 | Ex. 2 | Ex. 3 | Ex. 4 | Ex. 5 |
|---|---|---|---|---|---|
| Component a) | 4 | 3.3 | 3.5 | 3.3 | 3.5 |
| Component b) | 3.5 | 3.5 | 3.5 | 3.5 | 3.5 |
| OLOA-219 additive | — | 1.1 | 0.87 | 1.1 | 0.38 |
| HiTEC 7334 additive | 1 | — | — | — | — |
| HiTEC 7465 additive | — | — | — | — | 0.7 |
| HiTEC 7304 additive | 1.25 | — | — | — | — |
| HiTEC 614 additive | — | 0.7 | 0.7 | 0.7 | 0.7 |
| HiTEC 611 additive | 0.45 | 0.54 | 0.41 | 0.54 | 0.45 |
| HiTEC 7169 additive | 1.02 | 0.8 | 0.8 | 0.8 | 0.8 |
| HiTEC 7198 additive | 0.31 | 0.5 | 0.5 | 0.5 | 0.5 |
| HiTEC 7637 additive | 0.4 | 0.3 | 0.4 | 0.3 | 0.45 |
| Naugalube 438L additive | — | 0.2 | 0.2 | 0.2 | 0.2 |
| ECA 8743 additive | 0.5 | 0.7 | 0.6 | 0.7 | — |
| HiTEC 619 additive | — | — | — | — | 0.33 |
| HiTEC 7084 additive | — | 0.4 | — | 0.4 | — |
| HiTEC 4760 additive | 1.2 | — | — | — | — |
| HiTEC 4733 additive | — | — | — | — | 0.5 |
| Tolad 326 additive | 0.01 | 0.01 | 0.005 | 0.01 | 0.005 |
| HiTEC 029 additive | — | — | — | — | 0.15 |
| Foam inhibitor | 0.03 | 0.03 | 0.03 | 0.03 | 0.03 |
| Diluent oil | 0.33 | 0.42 | 0.685 | 0.42 | 0.805 |
| VI improver | 6.8[a] | 7.6[b] | 7.82[c] | 8.20[c] | — |
| Acrylic PPD | — | — | 0.15 | 0.15 | — |
| HiTEC 672 additive | 0.2 | — | — | — | 0.2 |
| 100N base oil | — | — | — | 15.04 | — |
| 150N base oil | 67.15 | 58.33 | 56.68 | — | — |
| 240N base oil | — | — | — | 64.11 | — |
| 370N base oil | — | — | — | — | 86.80 |
| 600N base oil | 11.85 | 21.57 | 23.15 | — | — |

[a]Star polymer viscosity index improver
[b]Non-dispersant olefin copolymer viscosity index improver
[c]Dispersant olefin copolymer viscosity index improver

| Components | Ex. 6 | Ex. 7 | Ex. 8 | Ex. 9 | Ex 10 |
|---|---|---|---|---|---|
| Component a) | 3.5 | 3.5 | 3.5 | 3.5 | 5.0 |
| Component b) | 3.5 | 3.5 | 3.5 | 3.5 | 3.0 |

TABLE I-continued

Illustrative Compositions

| | | | | | |
|---|---|---|---|---|---|
| OLOA-219 additive | — | — | 0.38 | 0.38 | 1.7 |
| HiTEC 7465 additive | 1.37 | 1.37 | 0.75 | 0.7 | — |
| HiTEC 614 additive | 0.7 | 0.7 | 0.7 | 0.7 | 1.0 |
| HiTEC 611 additive | 0.39 | 0.39 | 0.5 | 0.45 | 0.15 |
| HiTEC 7169 additive | 0.8 | 0.8 | 0.8 | 0.8 | — |
| HiTEC 7198 additive | 0.5 | 0.5 | 0.5 | 0.5 | 0.9 |
| HiTEC 7637 additive | — | — | 0.4 | 0.45 | — |
| Witco M-400 T/G additive | 0.45 | 0.45 | — | — | — |
| Naugalube 438L additive | 0.2 | 0.2 | 0.2 | 0.2 | 0.4 |
| ECA 8743 additive | 0.5 | — | 0.5 | — | 0.7 |
| HiTEC 619 additive | — | 0.33 | — | 0.33 | — |
| HiTEC 4760 additive | 0.5 | 0.5 | — | — | — |
| HiTEC 4733 additive | — | — | 0.5 | 0.5 | — |
| Tolad 326 additive | 0.005 | 0.005 | 0.005 | 0.005 | — |
| HiTEC 029 additive | 0.12 | 0.12 | 0.15 | 0.15 | — |
| Foam inhibitor | 0.03 | 0.03 | 0.03 | 0.03 | 0.03 |
| Diluent oil | 0.435 | 0.605 | 0.585 | 0.805 | 0.52 |
| VI improver | 7.75[c] | 7.75[c] | 7.75[c] | 8.0[b] | 11.0[d] |
| Acrylic PPD | 0.15 | 0.15 | 0.15 | — | — |
| HiTEC 672 additive | — | — | — | 0.3 | 0.2 |
| 150N base oil | 56.17 | 56.17 | 56.17 | — | — |
| 170N base oil | — | — | — | 60.6 | 64.0 |
| 370N base oil | — | — | — | 18.1 | 11.4 |
| 600N base oil | 22.93 | 22.93 | 22.93 | — | — |

[b]Non-dispersant olefin copolymer viscosity index improver
[c]Dispersant olefin copolymer viscosity index improver
[d]Dispersant olefin copolymer viscosity index improver

| Components | Ex 11 | Ex 12 | Ex 13 | Ex 14 | Ex 15 |
|---|---|---|---|---|---|
| Component a) | 5.0 | 5.0 | 5.0 | 5.0 | 3.5 |
| Component b) | 3.0 | 3.0 | 3.0 | 3.0 | 3.5 |
| OLOA-219 additive | 1.75 | — | 1.75 | — | — |
| HiTEC 7465 additive | — | 2.4 | — | 2.4 | 1.37 |
| HiTEC 614 additive | 1.0 | 1.0 | 1.0 | 1.0 | 0.7 |
| HiTEC 611 additive | — | — | — | — | 0.41 |
| HiTEC 7169 additive | 0.3 | 0.3 | 0.3 | 0.3 | 0.8 |
| HiTEC 7198 additive | 0.65 | 0.65 | 0.65 | 0.65 | 0.5 |
| HiTEC 7637 additive | — | — | — | — | 0.4 |
| Naugalube 438L additive | 0.4 | 0.4 | 0.4 | 0.4 | 0.2 |
| ECA 8743 additive | 0.7 | — | — | — | 0.6 |
| HiTEC 4760 additive | — | — | 1.0 | 1.0 | — |
| HiTEC 4733 additive | — | 0.5 | — | — | — |
| Tolad 326 additive | — | — | — | — | 0.005 |
| Foam inhibitor | 0.03 | 0.04 | 0.04 | 0.04 | 0.03 |
| Diluent oil | 0.52 | 0.51 | 0.51 | 0.51 | 0.485 |
| VI improver | 10.5[d] | 10.0[d] | 10.5[d] | 10.0[d] | 7.79[c] |
| Acrylic PPD | — | — | — | — | 0.15 |
| HiTEC 672 additive | 0.2 | 0.2 | 0.2 | 0.2 | — |
| 150N base oil | — | — | — | — | 56.49 |
| 170N base oil | 66.95 | 67.00 | 66.65 | 66.50 | — |
| 370N base oil | 9.00 | 9.00 | 9.00 | 9.00 | — |
| 600N base oil | — | — | — | — | 23.07 |

[c]Dispersant olefin copolymer viscosity index improver
[d]Dispersant olefin copolymer viscosity index improver

| Components | Ex 16 | Ex 17 | Ex 18 |
|---|---|---|---|
| Component a) | 3.5 | 3.5 | 3.5 |
| Component b) | 3.5 | 3.5 | 3.5 |
| OLOA-219 additive | — | 0.46 | 0.46 |
| HiTEC 7465 additive | — | 0.67 | 0.67 |
| HiTEC 614 additive | 1.25 | 1.25 | 0.7 |
| HiTEC 611 additive | 1.48 | 0.7 | 0.39 |
| HiTEC 7169 additive | 0.8 | 0.8 | 0.8 |
| HiTEC 7198 additive | 0.5 | 0.5 | 0.5 |
| HiTEC 7636 additive | — | 0.1 | — |
| Witco M-400 T/G additive | — | — | 0.45 |
| Naugalube 438L additive | 0.05 | 0.1 | 0.2 |
| ECA 8743 additive | — | — | 0.5 |
| HiTEC 4760 additive | 1.0 | — | — |
| HiTEC 4733 additive | — | 0.5 | — |
| Tolad 326 additive | — | — | 0.005 |

TABLE I-continued

| Illustrative Compositions | | | |
|---|---|---|---|
| HiTEC 029 additive | — | 0.2 | — |
| HiTEC 093 additive | 0.3 | 0.3 | — |
| Foam inhibitor | 0.014 | 0.03 | 0.03 |
| Diluent oil | 0.906 | 0.59 | 0.795 |
| VI improver | 5.4[d] | 5.41[d] | 6.5[d] |
| 160N base oil | 77.24 | 77.32 | 81.00 |
| 650N base oil | 4.06 | 4.07 | — |

[d]Dispersant acrylic viscosity index improver
[e]Dispersant olefin copolymer viscosity index improver

| Components | Ex 19 | Ex 20 | Ex 21 |
|---|---|---|---|
| Component a) | 5.0 | 5.0 | 3.5 |
| Component b) | 3.0 | 3.0 | 3.5 |
| OLOA-219 additive | — | 0.7 | 0.38 |
| HiTEC 7465 additive | 2.4 | 1.4 | 0.7 |
| HiTEC 614 additive | 1.0 | 1.0 | 0.7 |
| HiTEC 611 additive | — | — | 0.45 |
| HiTEC 7169 additive | 0.3 | 0.3 | 0.8 |
| HiTEC 7198 additive | 0.65 | 0.65 | 0.5 |
| HiTEC 7637 additive | — | — | 0.45 |
| Naugalube 438L additive | 0.4 | 0.4 | 0.2 |
| HiTEC 4760 additive | — | 0.6 | — |
| HiTEC 4733 additive | 0.6 | — | 0.5 |
| Tolad 326 additive | — | — | 0.005 |
| HiTEC 029 additive | — | — | 0.15 |
| Foam inhibitor | 0.04 | 0.04 | 0.03 |
| Diluent oil | 0.51 | 0.52 | 0.805 |
| VI improver | 10.0[e] | 10.0[e] | 7.0[f] |
| HITEC 672 additive | 0.2 | 0.2 | 0.3 |
| 100N base oil | — | — | 29.5 |
| 170N base oil | 66.9 | 65.5 | 50.2 |
| 370N base oil | 9.0 | 10.3 | — |

[e]Dispersant olefin copolymer viscosity index improver
[f]Non-dispersant olefin copolymer viscosity index improver The compositions of this invention exhibit a reduced tendency to deteriorate under conditions of use and thereby reduce wear and the formation of such undesirable deposits as varnish, sludge, carbonaceous materials and resinous materials which tend to adhere to various engine parts and reduce the efficiency of the engines.

The performance of the lubricants of this invention are evaluated by subjecting lubricant compositions to a number of engine oil tests which have been designed to evaluate a variety of performance characteristics of engine oils. For a lubricant to be qualified for particular industry service classifications, the lubricant must pass certain specified engine oil tests. However, lubricants which pass one or more of the individual tests are also useful for particular applications.

The ASTM Sequence, IIIE engine oil test has been recently established as a means of defining the high-temperature wear, oil thickening, and deposit protection capabilities of SG engine oils. The IIIE test, which replaces the Sequence IIID test, provides improved discrimination with respect to high temperature camshaft and lifter wear protection and oil thickening control. The IIIE test utilizes a Buick 3.8L V-6 model engine which is operated on leaded fuel at 67.8 bhp and 3000 rpm for a maximum test length of 64 hours. A valve springload of 230 pounds is used. A 100% glycol coolant is used because of the high engine operating-temperatures. Coolant outlet temperature is maintained at 118° C., and the oil temperature is maintained at 149° C. at an oil pressure of 30 psi. The air-to-fuel ratio is 16.5, and the blow-by rate is 1.6 cfm. The initial oil charge is 146 ounces.

The test is terminated when the oil level reaches 28 ounces low at any of the 8-hour check intervals. When the tests are concluded before 64 hours because of low oil level, the low oil level has generally resulted from hang-up of the heavily oxidized oil throughout the engine and its inability to drain to the oil pan at the 49° C. oil check temperature. Viscosities are obtained on the 8-hour oil samples, and from this data, curves are plotted of percent viscosity increase versus engine hours. A maximum 375% viscosity increase measured at 40° C. at 64 hours is required for APE classification SG. The engine sludge requirement is a minimum rating of 9.2, the piston varnish a minimum of 8.9, and the ring land deposit a minimum of 3.5 based on the CRC merit rating system. Details of the Sequence IIIE Test are contained in the ASTM Research Report: D-2:1225 of Apr. 1, 1988 including any and all amendments detailed by the Information Letter System (up to Nov. 1, 1990).

The results of Sequence IIIE tests conducted on lubricants of Examples 2, 6, 7, 8, 14 and 17 are summarized in Table II wherein the following abbreviations are used:

Adj Hrs Adjusted hours to reach 375% viscosity increase in the oil. Test specification is 64 hours minimum.

Eng Sludge Average engine sludge rating. Test specification is a rating of 9.2 minimum.

Avg Varnish Average engine varnish rating. Test specification is a rating of 8.9 minimum.

Avg RLD Average adjusted oil ring land deposit rating. Test specification is a rating of 3.5 minimum.

Avg Cam Wear Average cam wear in microns. Test specification is 30 microns maximum.

Max Cam Wear Maximum cam wear in microns. Test specification is 64 microns maximum.

Stuck Rings Test Specification is a maximum of one stuck ring with an average adjusted oil ring land deposit rating over 3.5.

TABLE II

| | Sequence IIIE Tests | | | | | |
|---|---|---|---|---|---|---|
| Results | Ex. 2 | Ex. 6 | Ex. 7 | Ex. 8 | Ex. 14 | Ex. 17 |
| Adj Hrs | 71.3 | 76.9 | 78.1 | 72.4 | 82.6 | 72.6 |
| Eng Sludge | 9.49 | 9.48 | 9.50 | 9.54 | 9.54 | 9.57 |
| Avg Varnish | 9.22 | 9.04 | 8.95 | 9.06 | 9.05 | 9.27 |
| Avg RLD | 6.57 | 8.26 | 7.53 | 7.90 | 7.36 | 5.53 |
| Avg Cam Wear | 5.2 | 9.2 | 4.3 | 1.5 | 7.1 | 6.2 |
| Max Cam Wear | 8 | 14 | 7 | 6 | 13 | 13 |
| # Stuck Rings | 0 | 0 | 0 | 0 | 0 | 0 |
| End Result | Pass | Pass | Pass | Pass | Pass | Pass |

The CRC L-38 test is a test developed by the Coordinating Research Council. This test method is used for determining the following characteristics of crankcase lubricating oils under high temperature operating conditions antioxidation, corrosive tendency, sludge and varnish producing tendency, and viscosity stability. The CLR engine features a fixed design, and is a single cylinder, liquid cooled, spark-ignition engine operating at a fixed speed and fuel flow. The engine has a one-quart crankcase capacity. The procedure requires that the CLR single cylinder engine be operated at 3150 rpm, approximately 5 bhp, 290° F. oil gallery temperature and 200° F. coolant-out temperature for 40 hours. The test is stopped every 10 hours for oil sampling and topping up. The viscosities of these oil samples are determined, and these numbers are reported as part of the test result.

A special copper-lead test bearing is weighed before and after the test to determine the weight loss due to corrosion. After the test, the engine also is rated for sludge and varnish deposits, the most important of which is the piston skirt varnish. The primary performance criteria for API Service Classification SG are bearing weight loss, mg, max of 40 and a piston skirt varnish rating (minimum) of 9.0

The L-38 procedure is set forth in ASTM D-5119, including any and all amendments detailed by the Information Letter System (up to Nov. 1, 1990).

Table III summarizes the L-38 test results on four lubricants of this invention. In Table III, the lowest viscosity measurements are expressed in terms of centistokes (cSt) at 100° C.

TABLE III

| | L-38 Tests | | | |
|---|---|---|---|---|
| Results | Ex. 6 | Ex. 7 | Ex. 9 | Ex. 14 |
| Bearing Weight Loss, mg | 18.8 | 14.9 | 18.4 | 28.7 |
| PSV Rating | 9.7 | 9.6 | 9.6 | 9.6 |
| Lowest Vis Measurement | 14.05 | 13.89 | 13.09 | 13.80 |
| End Result | Pass | Pass | Pass | Pass |

The Caterpillar 1K test procedure has been correlated with direct injection engines used in heavy-duty service, particularly in respect of piston and ring groove deposits. The test procedure is described in ASTM Research Report RR:D02 1273, "Caterpillar 1K Test ASTM Research Report."

Results on different compositions of this invention when subjected to the 1K test procedure are summarized in Table IV.

TABLE IV

| | 1K Tests | | | |
|---|---|---|---|---|
| Results | Ex. 1 | Ex. 2 | Ex. 11 | Ex. 14 |
| Top Groove Fill, % max. | 12 | 11 | 7 | 22 |
| Weighted Total Demerits | 258.3 | 228.9 | 210.5 | 317 |
| Top Land Heavy Carbon, % | 0 | 0 | 0 | 1 |
| Oil Consumption, g/Kw-hr | 0.19 | 0.16 | 0.13 | 0.18 |
| End Result | Pass | Pass | Pass | Pass |

The Caterpillar 1N diesel engine test is a recent test procedure used for predicting piston deposit formation in 4 stroke cycle, direct injection, diesel engines which have been calibrated to meet 1994 U.S. Federal Exhaust Emissions requirements for heavy-duty engines operated on fuel containing less than 0.05 weight percent sulfur. The primary test limit requirements on deposit control for one test, are: top groove fill, 20% max; weighted total demerits, 286; and top land heavy carbon, 3%.

Results on four lubricants of this invention using the Caterpillar 1N test procedure are summarized in Table V.

TABLE V

| | 1N Tests | | | |
|---|---|---|---|---|
| Results | Ex. 12 | Ex. 13 | Ex. 15 | Ex. 16 |
| Top Groove Fill, % max. | 10 | 9 | 8 | 10 |
| Weighted Total Demerits | 272.7 | 275 | 190.6 | 239.8 |
| Top Land Heavy Carbon, % | 0 | 0 | 0 | 0 |
| Oil consumption, g/Kw-hr | 0.15 | 0.25 | 0.12 | 0.34 |
| End Result | Pass | Pass | Pass | Pass |

The Mack T-6 test procedure is another qualification test for heavy duty engine oils. The test has been correlated with vehicles equipped with engines used in high-speed operation, particularly with respect to deposits, oil consumption, and piston ring wear. The test procedure itself is described in ASTM Research Report RR:DO2:1219, Multicylinder Engine Test Procedure for the Evaluation of Lubricants—Mack T-6.

Results from T-6 tests on several engine oils of this invention are summarized in Table VI.

TABLE VI

| | T-6 Tests | | |
|---|---|---|---|
| Results | Ex. 2 | Ex. 8 | Ex. 19 |
| Avg Oil Consumption, Merits | 37 | 37.4 | 25.4 |
| Avg Ring Weight Loss, Merits | 40 | 40 | 40 |
| Max Piston Proudness, Merits | 22.9 | 27.1 | 28.6 |
| Viscosity Increase, Merits | 22.5 | 17.6 | 22.4 |
| Piston Deposits, Merits | 17.2 | 15.6 | 19.2 |
| Total Mack Merits | 139.5 | 137.8 | 135.6 |
| End Result | Pass | Pass | Pass |

The Mack T-8 test is a relatively new engine test procedure. It involves determining viscosity increase due to soot formation during engine operation over a period of 250 hours. In order to pass the test, the 100° C. kinematic viscosity increase of the engine oil at a 3.8% soot level must not exceed 11.5 cSt. When the lubricants of Examples 10 and 20 were subjected to this procedure the results were viscosity increases of only 3.98 and 3.08 cSt, respectively, at the 3.8% soot level.

Another common qualification test is the Sequence IID test procedure. This test measures the rusting and corrosion characteristics of motor oils. The test procedure is set forth in ASTM STP 315H Part 1, including any and all amendments detailed by the Information Letter System (up to Nov. 1, 1990). The test relates to short trip service under winter driving conditions as encountered in the United States. The sequence IID uses an Oldsmobile 5.7 liter (350 CID) V-8 engine run under low speed (1500 rpm), low load conditions (25 bhp) for 28-hours-with engine coolant-in at 41° C. and the coolant-out at 43° C. Following this, the test operates for two hours at 1500 rpm with coolant-in at 47° C. and coolant-out at 49° C. After a carburetor and spark plug change, the engine is operated for the final two hours under high speed (3600 rpm), moderate load conditions (100 bhp) with coolant-in at 88° C. and the coolant-out at 93° C. Upon completion of the test (32 hours), the engine is inspected for rust using CRC rating techniques.

The results obtained on subjecting several engine oils of this invention to the IID procedure are summarized in Table VII.

TABLE VII

| | Sequence IID Tests | | |
|---|---|---|---|
| Results | Ex. 9 | Ex. 17 | Ex. 18 |
| Average Rust | 8.67 | 8.53 | 8.46 |
| Average Crankcase Pressure | 0.07 | 0.03 | 0.04 |
| Maximum Crankcase Pressure | 0.60 | 0.04 | 0.06 |
| End Result | Pass | Pass | Pass |

The Sequence VE test procedure is described in ASTM Sequence VE Test Procedure, Seventh Draft, May 19, 1988, including and all amendments detailed by the Information Letter System (up to Nov. 1, 1990).

The test uses a 2.3 liter 4-cylinder overhead cam engine equipped with a multi-point electronic fuel injection system, and the compression ratio is 9.5:1. The test procedure uses the same format as the Sequence VD test with a four-hour cycle consisting of three different stages. The oil temperatures (° F.) in Stages I, II, and III are 155/210/115, and the water temperatures (° F.) in three stages are 125/185/115, respectively. The test oil charge volume is 106 oz., and the rocker cover is jacketed for control of upper engine temperature. The speeds and loads of the three stages have not been changed from the VD test. The blow-by rate in Stage I is increased to 2.00 CFM from 1.8 CFM, and the test length is 12 days. The PCV valves are replaced every 48 hours in this test.

At the end of the test, engine sludge, rocker cover sludge, piston varnish, average varnish and valve train wear are rated.

Table VIII summarizes the Sequence VE test results on the lubricants of Examples 4 and 21.

TABLE VIII

| Sequence VE Tests | | | |
|---|---|---|---|
| Results | Ex. 3 | Ex. 21 | Test Limits |
| Average Sludge | 9.38 | 9.49 | 9.0 min. |
| Rocker Arm Cover Sludge | 9.2 | 9.27 | 7.0 min. |
| Average Engine Varnish | 6.18 | 6.20 | 5.0 min. |
| Piston Skirt Varnish | 6.79 | 7.53 | 6.5 min. |
| Average Cam Wear, mils | 0.58 | 0.37 | 5.0 max. |
| Maximum Cam Wear, mils | 0.5 | 0.10 | 15.0 max. |
| End Result | Pass | Pass | |

A test used for measuring corrosion is the Cummins L-10 Bench Corrosion Test which forms part of the new category, PC-6, to ASTM D4485, Standard Specification for Performance of Engine Oils. This test has been shown to predict corrosion of engine oil lubricated copper, lead, or tin containing components used in diesel engines. To pass this test, the maximum increase of metals in terms of parts per million (ppm) in the oil are as follows: copper, 20 ppm; lead, 60 ppm; tin, 50 ppm. In addition, the maximum copper corrosion rating pursuant to ASTM D130 is 3a. The procedure is described in ASTM Research Report RR:D02:DDDD Cummins Bench Corrosion Test.

L-10 corrosion results on several compositions of this invention are summarized in Table IX, wherein "nc" means no change in color of test specimen from its original color.

TABLE IX

| L-10 Corrosion Tests | | | |
|---|---|---|---|
| Results | Ex. 2 | Ex. 4 | Ex. 14 |
| Copper Rating | 1a | 1a | 1a |
| Copper in oil, ppm | 8 | 18 | 8 |
| Lead in oil, ppm | 17, nc | 47 nc | 24 |
| Tin in oil, ppm | 0 nc | 0 nc | 0 |
| End Result | Pass | Pass | Pass |

The General Motors 6.2 Liter test is another test used for measuring engine wear, and in particular rolling contact wear. This is a diesel engine test which has been shown to correlate with hydraulic roller cam follower pin wear in medium-duty indirect injection diesel engines used in broadly based field operations. Details of the test procedure are set forth in ASTM Research Report RR:D02:CCCC Development of the GM 6.2 Liter Wear Test.

Table X summarizes the results obtained when the compositions of Examples 2, 9 and 14 were subjected to the GM 6.2 liter wear test.

TABLE X

| General Motors 6.2 Liter Wear Tests | | | |
|---|---|---|---|
| Results | Ex. 2 | Ex. 9 | Ex. 14 |
| Minimum Wear, mils | 0.16 | 0.08 | 0.12 |
| Maximum Wear, mils | 0.40 | 0.36 | 0.26 |
| Average Wear, mils | 0.30 | 0.26 | 0.18 |
| End Result | Pass | Pass | Pass |

As pointed out above, the dispersant compositions of this invention are more effective in providing high temperature piston cleanliness performance than the closest known prior art dispersant composition, a dispersant composition which was used in heavy duty diesel lubricants. That composition was composed of component b) as described above and a succinimide dispersant of the same type as the above component a) except that the mole ratio of (i) to (ii) thereof was 2:1 instead of below about 1.85 as required pursuant to this invention. For evaluation of high temperature piston cleanliness performance, the standard Caterpillar 1K procedure was used. When employed as the dispersant on three occasions in an SAE 15W-40 heavy duty engine oil formulation that satisfied the requirements of API classification CE, the prior art dispersant gave three failing results in the Caterpillar 1K engine test procedure. In sharp contrast and as shown in Table IV, four different SAE 15W-40 heavy duty engine oils of this invention in which the dispersant was a dispersant composition of this invention all passed the Caterpillar 1K engine test. All such test data are summarized for ready reference in Table XI, wherein the following abbreviations are used:

TGF is Top Groove Fill, % max.;

WTD is Weighted Total Demerits;

TLHC is Top Land Heavy Carbon, %; and

OC is Oil Consumption, g/Kw-hr.

TABLE XI

| 1K Tests | | | | | | | |
|---|---|---|---|---|---|---|---|
| | Prior Art Dispersant | | | Dispersant of the Invention | | | |
| Results | No. 1 | No. 2 | No. 3 | Ex 1 | Ex. 2 | Ex 11 | Ex 14 |
| TGF | 70 | 38 | 21 | 12 | 11 | 7 | 22 |
| WTD | 441.1 | 282.3 | 400.8 | 258.3 | 228.9 | 210.5 | 317 |
| TLHC | 8 | 1 | 45 | 0 | 0 | 0 | 1 |
| OC | 0.19 | 0.20 | 1.05 | 0.19 | 0.16 | 0.13 | 0.18 |
| End Result | Fail | Fail | Fail | Pass | Pass | Pass | Pass |

As used herein the term "oil-soluble" means that the substance under discussion should be sufficiently soluble at 20° C. in the base oil selected for use to reach at least the minimum concentration required to enable the substance to serve its intended function. Preferably the substance will have a substantially greater solubility in the base oil than this. However, the substance need not dissolve in the base oil in all proportions.

Each and every U.S. patent document referred to hereinabove is fully incorporated herein by reference.

We claim:

1. A dispersant composition which comprises:

a) a first succinic derivative dispersant produced by reacting (i) a substituted succinic acylating agent in which the substituent is an aliphatic group derived from polyalkene having a GPC number average molecular weight in the range of about 700 to about 2500 with (ii) alkylene polyamine having an average of about 3 to about 6 nitrogen atoms per molecule, wherein the mole ratio of (i) to (ii) in said first succinic derivative dispersant is below about 1.85; and b) a second succinic derivative dispersant produced by reacting (iii) a substituted succinic acylating agent in which the substituent is an aliphatic group derived from polyalkene having a GPC number average molecular weight in the range of about 1100 to about 2800 with (iv) hydroxypropylated alkylene diamine having an average of 2 to about 12 carbon atoms per molecule and an average of about 2.5 to about 3.5 hydroxypropyl groups per molecule, wherein the mole ratio of (iii) to (iv) in said second succinic derivative dispersant is in the range of 1.0 to about 1.5;

the weight ratio of a) to b) being such that on an active ingredient basis there are from about 0.25 to about 10 parts by weight of a) per part by weight of b).

2. A composition according to claim 1 wherein the polyalkene of a) has a GPC number average molecular weight in the range of about 1250 to about 1400, and wherein the polyalkene of b) has a GPC number average molecular weight in the range of about 1800 to about 2400.

3. A composition according to claim 1 wherein the mole ratio of (i) to (ii) is about 1.8 to 1, and wherein the mole ratio of (iii) to (iv) is about 1 to 1.

4. A composition according to claim 1 wherein (ii) comprises a mixture of linear, branched and cyclic ethylene polyamines, and wherein (iv) is a hydroxypropylated hexamethylene diamine.

5. A composition according to claim 1 wherein said second succinic derivative dispersant is a borated succinic derivative dispersant.

6. A composition according to claim 1 wherein the polyalkene of a) has a GPC number average molecular weight in the range of about 1250 to about 1400, wherein the polyalkene of b) has a GPC number average molecular weight in the range of about 1800 to about 2400, wherein the mole ratio of (i) to (ii) is about 1.8 to 1, and wherein the mole ratio of (iii) to (iv) is about 1 to 1.

7. A composition according to claim 1 wherein the weight ratio of a) to b) is such that on an active ingredient basis there are from about 0.5 to about 5 parts by weight of a) per part by weight of b).

8. A composition according to claim 7 wherein the polyalkene of a) has a GPC number average molecular weight in the range of about 1250 to about 1400, and wherein the polyalkene of b) has a GPC number average molecular weight in the range of about 1800 to about 2400.

9. A composition according to claim 7 wherein the mole ratio of (i) to (ii) is about 1.8 to 1, and wherein the mole ratio of (iii) to (iv) is about 1 to 1.

10. A composition according to claim 7 wherein (ii) comprises a mixture of linear, branched and cyclic ethylene polyamines, and wherein (iv) is a hydroxypropylated hexamethylene diamine.

11. A composition according to claim 7 wherein said second succinic derivative dispersant is a borated succinic derivative dispersant.

12. A composition according to claim 7 wherein the polyalkene of a) has a GPC number average molecular weight in the range of about 1250 to about 1400, wherein the polyalkene of b) has a GPC number average molecular weight in the range of about 1800 to about 2400, wherein the mole ratio of (i) to (ii) is about 1.8 to 1, and wherein the mole ratio of (iii) to (iv) is about 1 to 1.

13. A composition according to claim 7 wherein the polyalkene of b) has a GPC number average molecular weight in the range of about 1250 to about 1400, wherein the polyalkene of c) has a GPC number average molecular weight in the range of about 1800 to about 2400, wherein (ii) comprises a mixture of linear, branched and cyclic ethylene polyamines, and wherein (iv) is a hydroxypropylated hexamethylene diamine.

14. A composition according to claim 7 wherein the succination ratio of a) is below about 1.3 and the succination ratio of b) is below about 1.3.

15. A composition according to claim 7 wherein the polyalkene of b) has a GPC number average molecular weight in the range of about 1250 to about 1400, and wherein the polyalkene of c) has a GPC number average molecular weight in the range of about 1800 to about 2400, wherein the mole ratio of (i) to (ii) is about 1.8 to 1, wherein the mole ratio of(iii) to (iv) is about 1 to 1, wherein (ii) comprises a mixture of linear, branched and cyclic ethylene polyamines, and wherein (iv) is a hydroxypropylated hexamethylene diamine.

16. A composition according to claim 15 wherein said second succinic derivative dispersant is a borated succinic derivative dispersant.

17. A composition which comprises from 0.5 to 99.5 wt % of a composition according to claim 1 and from 99.5 to 0.5 wt % of at least one oil of lubricating viscosity.

18. A composition which comprises from 0.5 to 99.5 wt % of a composition according to claim 5 and from 99.5 to 0.5 wt % of at least one oil of lubricating viscosity.

19. A composition which comprises from 0.5 to 99.5 wt % of a composition according to claim 7 and from 99.5 to 0.5 wt % of at least one oil of lubricating viscosity.

20. A composition which comprises from 0.5 to 99.5 wt % of a composition according to claim 11 and from 99.5 to 0.5 wt % of at least one oil of lubricating viscosity.

21. A composition which comprises from 0.5 to 99.5 wt % of a composition according to claim 16 and from 99.5 to 0.5 wt % of at least one oil of lubricating viscosity.

22. A lubricant composition which comprises a major amount of at least one oil of lubricating viscosity and at least the following additive components:

a) a first succinic derivative dispersant produced by reacting (i) a substituted succinic acylating agent in which the substituent is an aliphatic group derived from polyalkene having a GPC number average molecular weight in the range of about 700 to about 2500 with (ii) alkylene polyamine having an average of about 3 to about 6 nitrogen atoms per molecule, wherein the mole ratio of (i) to (ii) in said first succinic derivative dispersant is below about 1.85;

b) a second succinic derivative dispersant produced by reacting (iii) a substituted succinic acylating agent in which the substituent is an aliphatic group derived from polyalkene having a GPC number average molecular weight in the range of about 1100 to about 2800 with (iv) hydroxypropylated alkylene diamine having an average of 2 to about 12 carbon atoms per molecule and an average of about 2.5 to about 3.5 hydroxypropyl groups per molecule, wherein the mole ratio of (iii) to (iv) in said second succinic derivative dispersant is in the range of 1.0 to about 1.5; wherein the weight ratio of a) to b) is such that on an active ingredient basis there are from about 0.25 to about 10 parts by weight of a) per part by weight of b);

c) at least one calcium phenate or calcium sulfurized phenate composition having a TBN in the range of about 160 to about 260; and d) at least one calcium sulfonate having a TBN of up to about 420;

the amount of components c) and d) being such that if said calcium sulfonate has a total base number of up to about 50 mg KOH/gram, the total sulfated ash content of said lubricant composition is no higher than about 1.8 wt % whereas if said calcium sulfonate has a total base number greater than about 50 mg KOH/gram, the total sulfated ash content of said lubricant composition is up to about 2.5 wt %.

23. A composition in accordance with claim 22 which further comprises:

e) at least one oil-soluble dithiophosphate material in an amount such that the finished lubricant contains in the range of about 0.02 to about 0.18 wt % of phosphorus as said dithiophosphate material.

24. A composition in accordance with claim 22 or claim 23 wherein said second succinic derivative dispersant is a borated succinic derivative dispersant.

25. A composition in accordance with claim 22 or claim 23 wherein said first succinic derivative dispersant is a non-borated succinic derivative dispersant.

26. A composition in accordance with claim 22 or claim 23 wherein said first succinic derivative dispersant is a non-borated succinic derivative dispersant and said second succinic derivative dispersant is a borated succinic derivative dispersant.

27. An additive concentrate composition which comprises a minor amount of at least one inert diluent oil and a major amount of additive components, said additive components comprising at least the following components:

a) a first succinic derivative dispersant produced by reacting (i) a substituted succinic acylating agent in which the substituent is an aliphatic group derived from polyalkene having a GPC number average molecular weight in the range of about 700 to about 2500 with (ii) alkylene polyamine having an average of about 3 to about 6 nitrogen atoms per molecule, wherein the mole ratio of (i) to (ii) in said first succinic derivative dispersant is below about 1.85;

b) a second succinic derivative dispersant produced by reacting (iii) a substituted succinic acylating agent in which the substituent is an aliphatic group derived from polyalkene having a GPC number average molecular weight in the range of about 1100 to about 2800 with (iv) hydroxypropylated alkylene diamine having an average of 2 to about 12 carbon atoms per molecule and an average of about 2.5 to about 3.5 hydroxypropyl groups per molecule, wherein the mole ratio of (iii) to (iv) in said second succinic derivative dispersant is in the range of 1.0 to about 1.5; wherein the weight ratio of a) to b) is such that on an active ingredient basis there are from about 0.25 to about 10 parts by weight of a) per part by weight of b);

c) at least one calcium phenate or calcium sulfurized phenate composition having a TBN in the range of about 160 to about 260; and d) at least one calcium sulfonate having a TBN of up to about 420.

28. A composition in accordance with claim 27 which further comprises e) at least one oil-soluble dithiophosphate material.

29. A composition in accordance with claim 27 or claim 28 wherein said second succinic derivative dispersant is a borated succinic derivative dispersant.

30. A composition in accordance with claim 27 or claim 28 wherein said first succinic derivative dispersant is a non-borated succinic derivative dispersant.

31. A composition in accordance with claim 27 or claim 28 wherein said first succinic derivative dispersant is a non-borated succinic derivative dispersant and said second succinic derivative dispersant is a borated succinic derivative dispersant.

32. A lubricant composition which comprises a major amount of at least one oil of lubricating viscosity and at least the following additive components:

a) a first succinic derivative dispersant produced by reacting (i) a substituted succinic acylating agent in which the substituent is an aliphatic group derived from polyalkene having a GPC number average molecular weight in the range of about 700 to about 2500 with (ii) alkylene polyamine having an average of about 3 to about 6 nitrogen atoms per molecule, wherein the mole ratio of (i) to (ii) in said first succinic derivative dispersant is below about 1.85;

b) a second succinic derivative dispersant produced by reacting (iii) a substituted succinic acylating agent in which the substituent is an aliphatic group derived from polyalkene having a GPC number average molecular weight in the range of about 1100 to about 2800 with (iv) hydroxypropylated alkylene diamine having an average of 2 to about 12 carbon atoms per molecule and an average of about 2.5 to about 3.5 hydroxypropyl groups per molecule, wherein the mole ratio of (iii) to (iv) in said second succinic derivative dispersant is in the range of 1.0 to about 1.5; wherein the weight ratio of a) to b) is such that on an active ingredient basis there are from about 0.25 to about 10 parts by weight of a) per part by weight of b); and e) at least one oil-soluble dithiophosphate material in an amount such that said lubricant composition contains in the range of about 0.02 to about 0.18 wt % of phosphorus as said dithiophosphate material.

33. A composition in accordance with claim 32 wherein said second succinic derivative dispersant is a borated succinic derivative dispersant.

34. A composition in accordance with claim 32 wherein said first succinic derivative dispersant is a non-borated succinic derivative dispersant.

35. A composition in accordance with claim 32 wherein said first succinic derivative dispersant is a non-borated succinic derivative dispersant-and said second succinic derivative dispersant is a borated succinic derivative dispersant.

36. An additive concentrate composition which comprises a minor amount of at least one inert diluent oil and a major amount of additive components, said additive components comprising at least the following components:

a) a first succinic derivative dispersant produced by reacting (i) a substituted succinic acylating agent in which the substituent is an aliphatic group derived from polyalkene having a GPC number average molecular weight in the range of about 700 to about 2500 with (ii) alkylene polyamine having an average of about 3 to about 6 nitrogen atoms per molecule, wherein the mole ratio of (i) to (ii) in said first succinic derivative dispersant is below about 1.85;

b) a second succinic derivative dispersant produced by reacting (iii) a substituted succinic acylating agent in which the substituent is an aliphatic group derived from polyalkene having a GPC number average molecular weight in the range of about 1100 to about 2800 with (iv) hydroxypropylated alkylene diamine having an average of 2 to about 12 carbon atoms per molecule and an average of about 2.5 to about 3.5 hydroxypropyl groups per molecule, wherein the mole ratio of (iii) to (iv) in said second succinic derivative dispersant is in the range of 1.0 to about 1.5; wherein the weight ratio of a) to b) is such that on an active ingredient basis there are from about 0.25 to about 10 parts by weight of a) per part by weight of b); and e) at least one oil-soluble dithiophosphate material in an amount such that said when said additive concentrate is used to formulate a finished lubricant composition, said finished lubricant composition will contain in the range of about 0.02 to about 0.18 wt % of phosphorus as said dithiophosphate material.

37. A composition in accordance with claim 36 wherein said second succinic derivative dispersant is a borated succinic derivative dispersant.

38. A composition in accordance with claim 36 wherein said first succinic derivative dispersant is a non-borated succinic derivative dispersant.

39. A composition in accordance with claim 36 wherein said first succinic derivative dispersant is a non-borated succinic derivative dispersant and said second succinic derivative dispersant is a borated succinic derivative dispersant.

40. A composition in accordance with any of claims 22, 23, 27, 28, 32 and 36 further comprising: f) at least one oil-soluble antioxidant; g) at least one oil-soluble demulsifying agent; and h) at least one oil-soluble rust inhibitor.

* * * * *